US008145096B2

(12) United States Patent
Kawanami et al.

(10) Patent No.: US 8,145,096 B2
(45) Date of Patent: Mar. 27, 2012

(54) IMAGE FORMING APPARATUS HAVING A PROCESS CARTRIDGE REMOVABLE FROM A MAIN BODY OF THE APPARATUS HAVING IMPROVED USABILITY

(75) Inventors: Takeo Kawanami, Mishima (JP); Tomio Noguchi, Suntou-gun (JP); Chikara Imaizumi, Numazu (JP); Hiromi Sakurai, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 586 days.

(21) Appl. No.: 12/271,474

(22) Filed: Nov. 14, 2008

(65) Prior Publication Data

US 2009/0129812 A1 May 21, 2009

(30) Foreign Application Priority Data

Nov. 21, 2007 (JP) ..... 2007-301816

(51) Int. Cl.
*G03G 21/16* (2006.01)

(52) U.S. Cl. ..... 399/111; 399/110

(58) Field of Classification Search ..... 399/110–112
See application file for complete search history.

(56) References Cited

U.S. PATENT DOCUMENTS

| | | | |
|---|---|---|---|
| 5,608,498 | A | 3/1997 | Nagase et al. |
| 2007/0071482 | A1 | 3/2007 | Okabe |
| 2007/0160380 | A1 | 7/2007 | Imaizumi et al. |

FOREIGN PATENT DOCUMENTS

| | | | |
|---|---|---|---|
| JP | 04-121757 | A | 4/1992 |
| JP | 08-220824 | A | 8/1996 |
| JP | 2005-037584 | A | 2/2005 |
| JP | 2007-213018 | A | 8/2007 |

*Primary Examiner* — Hoang Ngo
(74) *Attorney, Agent, or Firm* — Canon USA Inc IP Division

(57) ABSTRACT

The present invention includes two side-plates configured to be opposed to each other and to form a frame of a main body of the apparatus, a cartridge with an image bearing member, a moving member configured to support and move the cartridge, a connecting member configured to connect the two side-plates, and a positioning member configured to be held by the connecting member, wherein the moving member, which is movable between the two side-plates, the cartridge is attachable to and detachable from the moving member when the moving member is withdrawn to the outside of the main body of the apparatus, and the cartridge is positioned by the positioning member when the moving member is moved and the cartridge is contained in the main body of the apparatus.

8 Claims, 30 Drawing Sheets

DOOR 31 - CLOSED STATE

DOOR 31 - HALFWAY OPEN STATE

DOOR 31 - COMPLETE OPEN STATE

IMAGE FORMING APPARATUS HAVING A PROCESS CARTRIDGE REMOVABLE FROM A MAIN BODY OF THE APPARATUS HAVING IMPROVED USABILITY

BACKGROUND OF THE INVENTION

1. Field of the Invention

The present invention relates to an image forming apparatus using an electrophotographic method such as an electrophotographic copying machine, an electrophotographic printer (for example, a laser beam printer, and a light emitting diode (LED) printer), a facsimile machine, and a word processor. More specifically, the present invention relates to an image forming apparatus of which a process cartridge is configured to be removable from a main body of the apparatus.

2. Description of the Related Art

An image forming apparatus discussed in Japanese Patent Application Laid-Open No. 08-220824 is configured such that a process cartridge can be withdrawn from a main body of the apparatus. In this conventional image forming apparatus, the cartridge is supported on an elevating plate which moves back/forth and up/down in synchronization with a side cover, via a two-staged retractable guide member. When a side cover is opened, the cartridge is elevated from an image forming position to a withdrawing position, which allows a user to withdraw the cartridge directly from the image forming apparatus. Accordingly, attachment/detachment of various equipments and removal of a jammed paper sheet have become possible by moving the cartridge to a specific position including a stop position.

However, in the above-described art, since the cartridge is supported on an elevating plate, even when placed at the image forming position, the cartridge is not precisely positioned, so that a precise positioning of the cartridge in image formation has been demanded with respect to a main body having high rigidity.

SUMMARY OF THE INVENTION

The present invention is directed to an image forming apparatus improved in a usability in exchanging a process cartridge, which achieves highly precise positioning of the process cartridge in image formation.

According to an aspect of the present invention, an image forming apparatus includes two side-plates configured to be opposed to each other and to form a frame of a main body of the apparatus, a cartridge with an image bearing member, a moving member configured to support and move the cartridge, a connecting member configured to connect the two side-plates, and a positioning member held by the connecting member, wherein the moving member is movable between the two side-plates, and the cartridge is attachable to and detachable from the moving member when the moving member is withdrawn to the outside of the main body of the apparatus, and the cartridge is positioned by the positioning member when the moving member is moved and the cartridge is contained in the main body of the apparatus.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DETAILED DESCRIPTION OF THE EMBODIMENTS

Various exemplary embodiments, features, and aspects of the invention will be described in detail below with reference to the drawings.

An overall schematic configuration of the image forming apparatus will be described below with reference to FIGS. 1, 2, 7, and 8.

Figure 1:
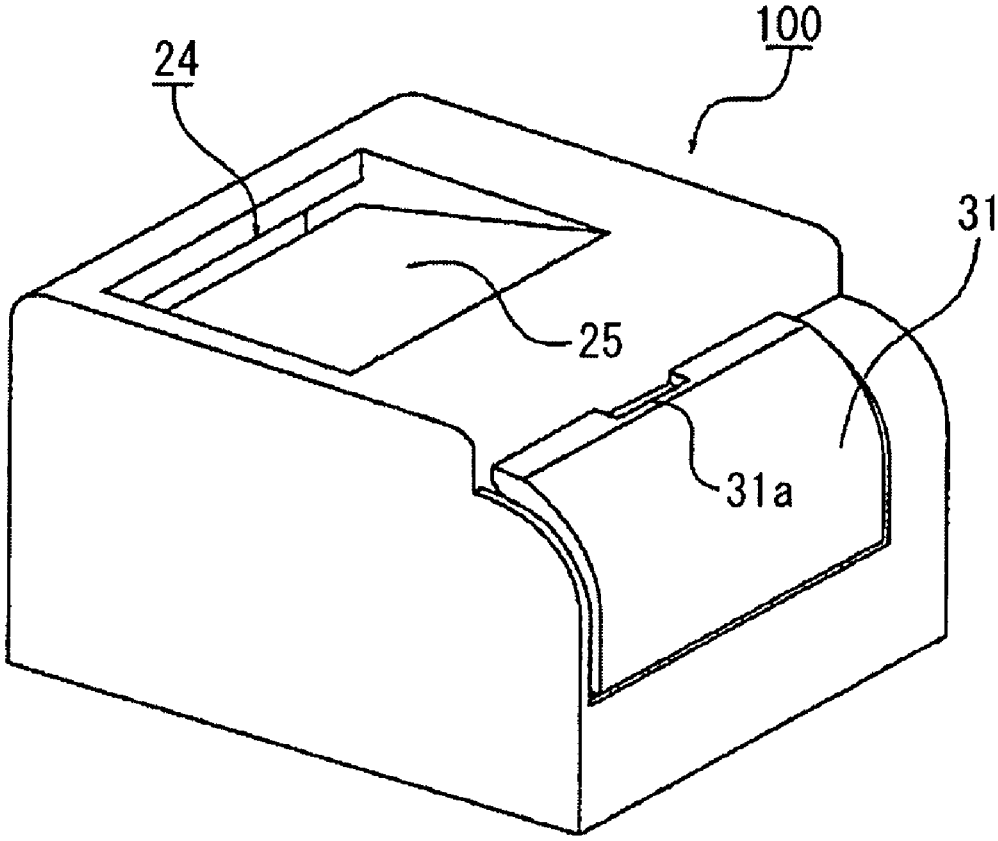
FIG. 1 is a perspective view illustrating an appearance of an image forming apparatus according to an exemplary embodiment of the present invention.
Figure 2:
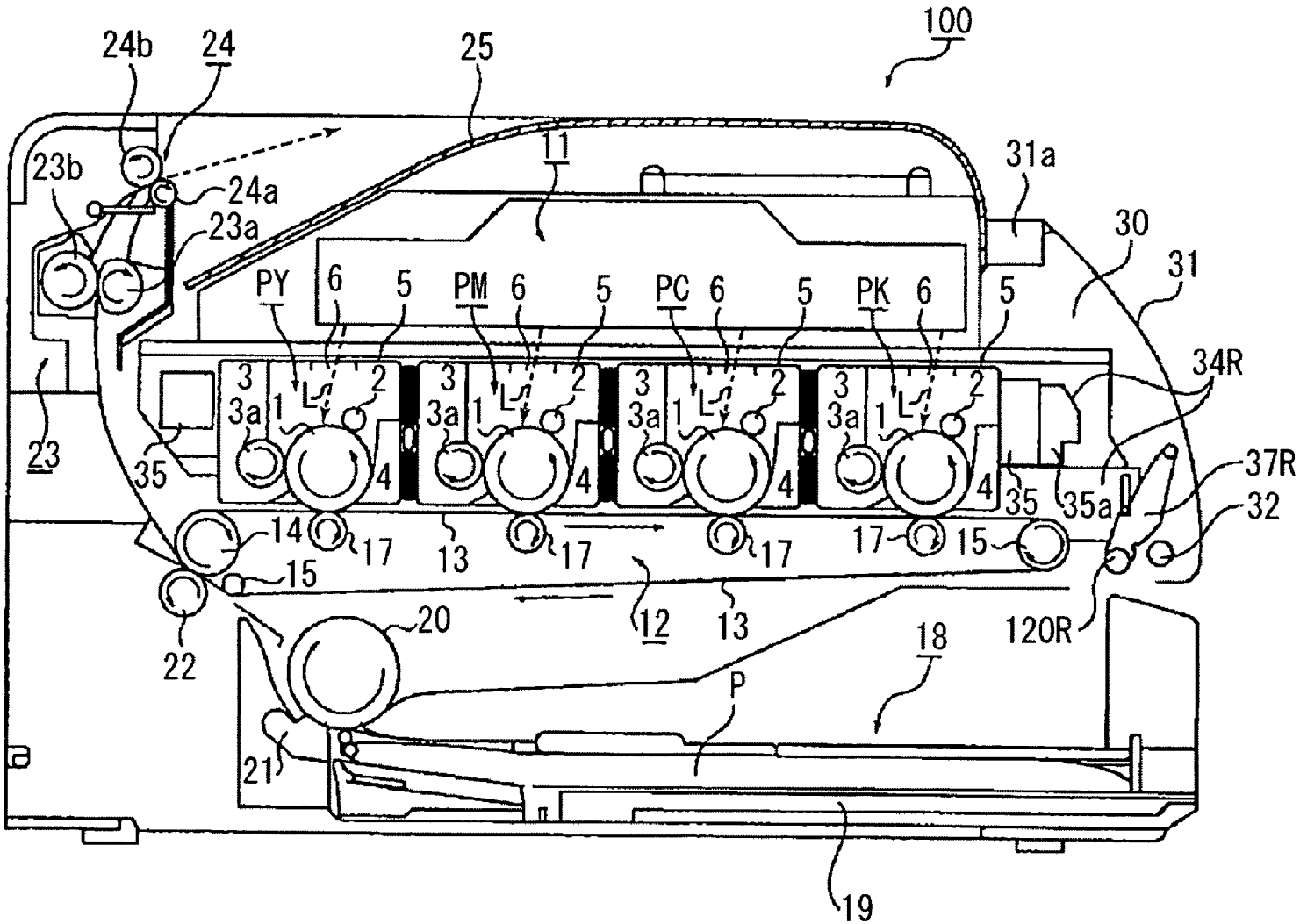
FIG. 2 is a cross-sectional view of the image forming apparatus.

FIG. 1 is a perspective view illustrating an appearance of an image forming apparatus 100 according to an exemplary embodiment of the present invention. FIG. 2 is a cross-sectional view thereof. The image forming apparatus is a full-color laser printer of four colors using an electrophotographic process, and executes an image formation onto a recording medium (a paper sheet) based on an electric image signal received from an external host device such as a personal computer, an image reader, or a facsimile apparatus.

In the following description, a front side (a front face side) of the image forming apparatus is a side where an opening/closing door 31 of the apparatus is disposed. A rear side of the apparatus is an opposite side of the front side. A longitudinal direction is a direction from the rear side of the main body of the apparatus toward the front side (forward direction) and a direction opposite thereto (a rearward direction). The left side or the right side of the apparatus is the left or the right of the main body when it is viewed from the front side of the main body. A horizontal direction is a direction from right to left (leftward direction) and a direction opposite to the leftward direction (rightward direction).

The main body of the apparatus includes four process cartridges PY, PM, PC, PK, i.e., first through fourth process cartridges, arranged in a horizontal direction from the rear side to the front side in this order (in-line configuration, tandem arrangement). Each of the process cartridges has a configuration similar to each other but only has a difference in toner colors stored therein. Each process cartridge of the present exemplary embodiment is configured such that an electrophotographic photosensitive drum 1 as a first image bearing member, a charging device 2 as a processing unit acting on the drum 1, a developing unit 3, and a cleaning device 4 are assembled together within a cartridge frame member 5 (see FIGS. 7 and 8). In other words, each process cartridge includes an image bearing member.

The charging device 2 is a contact charging type roller. The developing unit 3 includes a developing roller 3*a* and a developer container stores a developer (toner). The cleaning device 4 is of a blade type.

The first cartridge PY includes the developing unit 3 storing a yellow (Y) toner and forms a Y-color toner image on a surface of the drum 1. The second cartridge PM includes the developing unit 3 storing a magenta (M) toner and forms an M-color toner image on a surface of the drum 1. The third cartridge PC includes the developing unit 3 storing a cyan (C) toner and forms a C-color toner image on a surface of the drum 1. The fourth cartridge PK includes the developing unit 3 storing a black (K) toner and forms a K-color toner image on surface of the drum 1.

A laser scanner unit 11 is disposed above the process cartridges PY, PM, PC and PK. The laser scanner unit 11 outputs a laser beam L modulated according to image information of each of the colors output from an external host apparatus, and scan a surface of the drum 1 of each of the process cartridges through an exposure window 6 provided on a top surface of the cartridge frame member 5 (see FIGS. 7 and 8), so that the surface of the drum 1 is scanned and exposed to light.

An intermediate transfer belt unit 12 is disposed below the process cartridges PY, PM, PC, PK. The intermediate transfer belt unit 12 includes an endless belt 13 as an intermediate transfer member (second image bearing member) having a dielectric property and flexibility, a driving roller 14, a turn roller 15, and a tension roller 16. The endless belt 13 is tensioned around the driving roller 14, the turn roller 15, and the tension roller 16 to be circulated therearound. The driving roller 14 and the tension roller 16 are disposed at the rear side of the main body of the apparatus. The turn roller 15 is disposed at the front side of the main body. A lower surface of the drum 1 of the process cartridges PY, PM, PC and PK contacts an upper surface of the upper side belt portion of the endless belt 13. Four primary transfer rollers 17, each of which is opposed to the corresponding drum 1 of each process cartridge PY, PM, PC and PK through the upper side belt portion, are disposed inside the endless belt 13. A secondary transfer roller 22 contacts the driving roller 14 through the endless belt 13.

A paper sheet feeding unit 18 is disposed below the belt unit 12. The paper sheet feeding unit 18 includes a paper feed tray 19, a paper sheet feeding roller 20 and a separating pad 21. The paper sheet feeding tray 19 is withdrawable from the front side of the main body of the apparatus (front loading).

A fixing apparatus 23 and a pair of paper sheet discharge rollers 24 are disposed in an upper portion of the rear side in the main body of the apparatus. A top surface of the main body is formed into a paper sheet discharge tray 25. The fixing apparatus 23 includes a fixing film assembly 23*a* and a pressure roller 23*b*. The pair of paper sheet discharge rollers 24 includes a paper sheet discharge roller 24*a* and a paper sheet discharge collar 24*b*.

Each process cartridge at a loading position in the main body of the apparatus is pressed by a below-described pressing member to be kept in a fixed state at a predetermined positioning portion. A drive power output portion at the main body side is coupled to a drive power input portion of the process cartridge. A power supply system at the main body side is electrically connected with an electrical contact of the process cartridge.

An operation of forming a full-color image will be described below. The electrophotographic photosensitive drum 1 of the first through the fourth process cartridges PY, PM, PC, PK is rotationally driven at a predetermined control speed in a counterclockwise direction as indicated by an arrow. The endless belt 13 is also rotationally driven at a speed corresponding to the speed of the drum 1 in a clockwise direction (a direction identical to the rotation of the drum) as indicated by an arrow. The scanner unit 11 is also driven. In synchronization with the drive of the cartridges and the endless belt 13, a charging roller 2 of each process cartridge charges a surface of the drum 1 uniformly with a predetermined polarity and potential at a predetermined timing. The scanner unit 11 scans the surface of the drum 1 by a laser light L modulated in accordance with an image signal of each color and exposes the surface to light. Accordingly, the surface of each drum 1 is provided with an electrostatic latent image according to the image signal of the corresponding color. The thus formed electrostatic latent image is developed as a toner image by the developing unit 3.

According to the above-described electrophotographic image forming process operation, a Y-color toner image corresponding to a yellow component of the full-color image is formed on the drum 1 of the first process cartridge PY, and the toner image is primary transferred onto the endless belt 13.

An M-color toner image corresponding to a magenta component of the full-color image is formed on the corresponding drum 1 of the second process cartridge PM, and the M-color toner image is primary transferred, i.e., superimposed on the Y-color toner image having already been transferred onto the endless belt 13.

A C-color toner image corresponding to a cyan component of the full-color image is formed on the corresponding drum 1 of the third cartridge PC, and the C-color toner image is primary transferred, i.e., superimposed on the Y-color toner image and the M-color toner image having already been transferred onto the endless belt 13.

A K-color toner image corresponding to a black component of the full-color image is formed on the corresponding drum 1 of the fourth process cartridge PC, and the K-color toner image is primary transferred, i.e., superimposed on the Y-color toner image, the M-color toner image, and the C-color toner image having already been transferred onto the endless belt 13.

Accordingly, unfixed toner images made of the four colors such as the Y-color, the M-color, the C-color, and the K-color are combined and formed on the endless belt 13.

In each process cartridge, a residual transfer toner left on the surface of the drum 1 after the primary transfer of the toner images onto the endless belt 13 is removed by the cleaning device 4.

On the other hand, the paper sheet feeding roller 20 is driven at a predetermined control timing. Accordingly, one piece of sheet paper P as a recording material stacked on the sheet paper feeding tray 19 is separated under a cooperation of the paper sheet feeding roller 20 and the separating pad 21. Then, the separated sheet paper P is supplied to and introduced into a nip portion (secondary transfer nip portion) between the secondary transfer roller 22 and the endless belt 13. After that, the superimposed four-color toner image on the endless belt 13 is transferred onto the sheet paper P at once while the sheet paper P is pinched and conveyed by the nip portion.

The sheet paper P is separated from a surface of the endless belt 13 to be introduced into the fixing apparatus 23, and heated and pressed at a fixing nip portion. Accordingly, the color toner images are mixed and fixed onto the sheet paper. Then, the sheet paper P comes out of the fixing apparatus 23 to be discharged onto the paper sheet discharge tray 25 as a full-color image formed object with the help of the paired paper sheet discharge rollers 24.

The toner left after the secondary transfer on the surface of the endless belt 13 after the sheet paper is separated is electrostatically returned to the surface potential of the drum 1 by a primary transfer unit of the first process cartridge PY and removed by the cleaning device 4.

A method of exchanging the process cartridges will be described below with reference to FIGS. 1 through 10, 17, 19A, 19B, 22, and 23.

In each of the first through the fourth process cartridges PY, PM, PC and PK, a developer stored in the developing unit 3 is consumed as the developer is used in image formation. When the developer is consumed to a degree that a user who purchased the process cartridge is not satisfied with quality of a formed image, the cartridge loses its commercial value.

In view of the above, for example, a unit (not shown) configured to detect a residual amount of the developer of the individual process cartridge is provided to make a comparison between a detected residual amount and a threshold value at a control unit in order to notify the residual cartridge life or to alarm the user about the residual life. Then, if a residual quantity of the process cartridge is detected to be less than the threshold value, the notification of the residual life or the alarm of the residual life is displayed on a display unit. Thus, the user is prompted to prepare a new process cartridge to be exchanged, or to exchange the process cartridge with a new one in order to maintain quality of the output image.

In the image forming apparatus according to the present exemplary embodiment, as a method of exchanging the process cartridge, the process cartridge can be withdrawn being placed on a tray and exchanged through a front access, which enhances usability.

In other words, the image forming apparatus includes at its front surface side an opening portion 30 (see FIGS. 3 and 4) configured to insert the process cartridge into the main body of the apparatus and to take out the process cartridge from the main body.

Further, the image forming apparatus is provided with a door (an opening/closing member) 31 which is movable between a closed position for closing the opening portion 30 and an open position for opening the opening portion 30.

Figure 3:
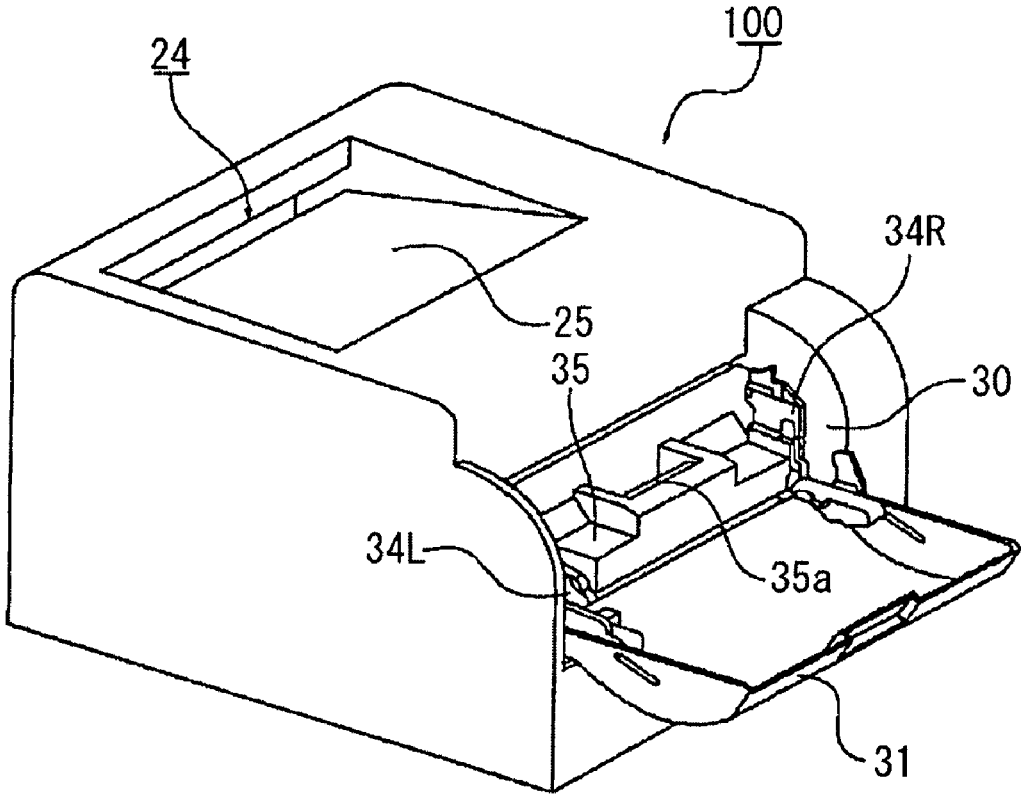
FIG. 3 is a view illustrating the image forming apparatus with a door opened.
Figure 4:
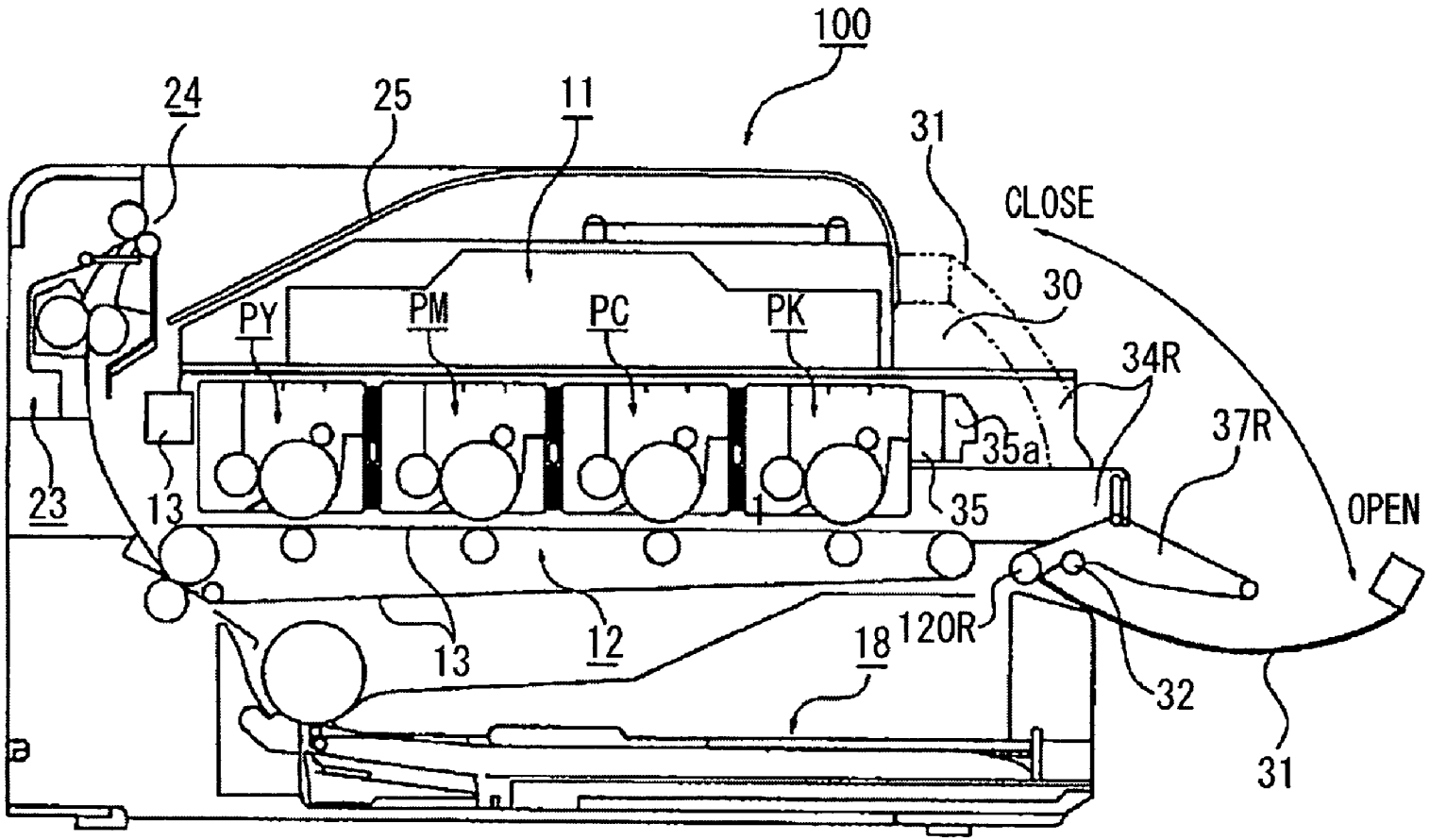
FIG. 4 is a cross-sectional view of the image forming apparatus of FIG. 3.

In the present exemplary embodiment, the door 31 can be rotated to be open/closed around a horizontal shaft (hinge shaft) 32 at a lower side of the door with respect to the main body of the apparatus. More specifically, the door 31 rotates around the hinge shaft 32 in a direction of raising the door, which is shut into the main body, so that the door is closed as illustrated in FIGS. 1 and 2. The opening portion 30 is shut down by closing the door 31. Further, the door 31 can be rotated around the hinge shaft 32 to lie flat at a front side of the main body, thereby opening the door 31 from the main body as illustrated in FIGS. 3 and 4. Accordingly, the opening portion 30 in a front surface of the main body is widely opened up. A hooking portion 31*a* for opening and closing is provided in the door 31.

A pair of left and right tray holding members (moving unit) 34L and 34R are disposed on an inside of the left frame 80L (see FIG. 17) and an inside of the right frame 80R (see FIG. 23) serving as side plates of a main frame which constitutes a frame of the main body of the apparatus. The left and the right tray holding members 34L and 34R are opposed to each other and their longer sides are oriented in a back-and-forth direction. A cartridge tray (moving member) 35 as a frame-shaped member is held between the tray holding members 34L and 34R such that the cartridge tray can horizontally slide in a back-and-forth direction. The process cartridges PY, PM, PC and PK are supported by the cartridge tray 35. In other words, the moving member 35 moves while it supports the process cartridges, and is movable between the two side-plates 80L and 80R which are opposed to each other to form the frame of the main body.

Tray holding members 34L and 34R move upwardly in a forward direction for a predetermined distance in association with the opening rotation of the door 31 as set forth below. Accordingly, front side portions of the tray holding members 34L and 34R are withdrawn through the opening portion 30 such that the front side portions project to the outside of the main body of the apparatus as illustrated in FIGS. 3 and 4. An interlocking mechanical system between the door 31 and the tray holding members 34L, 34R will be described below.

Further, in association with the movement of the tray holding members 34L and 34R, a coupling is released (drive release) between the drive power input portion of the process cartridges PY, PM, PC and PK and the drive power output portion at the main body side. Furthermore, a pressing force of the pressing member which positions and secures each process cartridge is released (pressure release). Still further, the power supply system at the main body side is electrically shut from the contact of each process cartridge (power feeding release). Still further, positioning and securing of the cartridge tray 35 is released.

Figure 5:
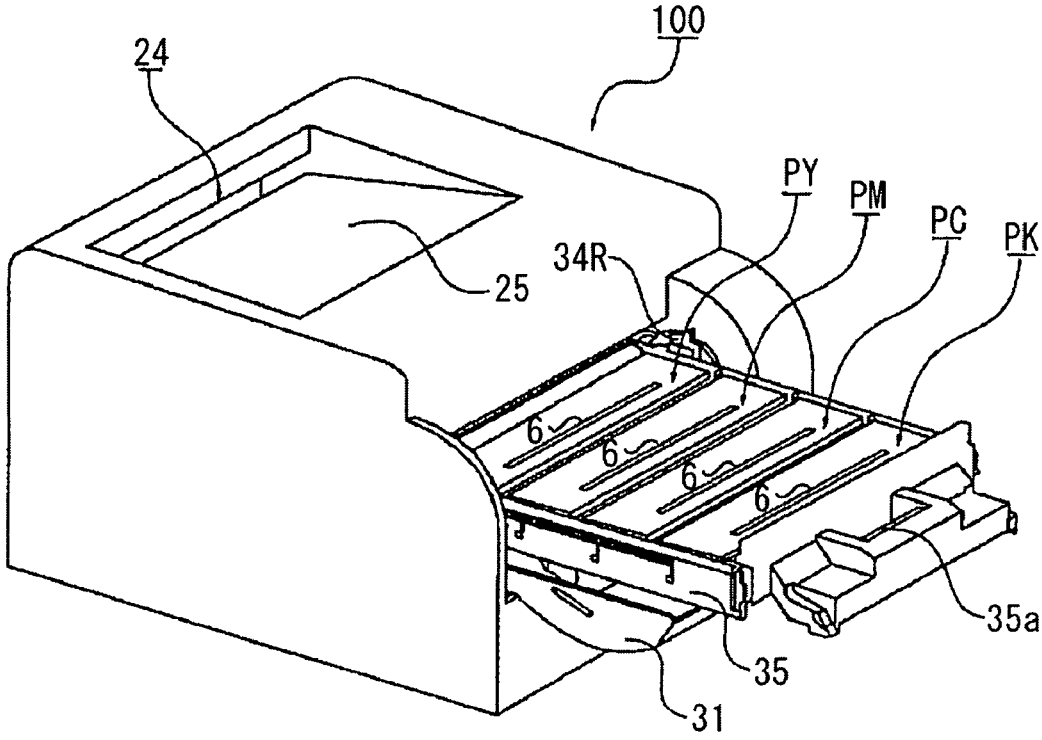
FIG. 5 is a view illustrating the image forming apparatus with a tray withdrawn.
Figure 6:
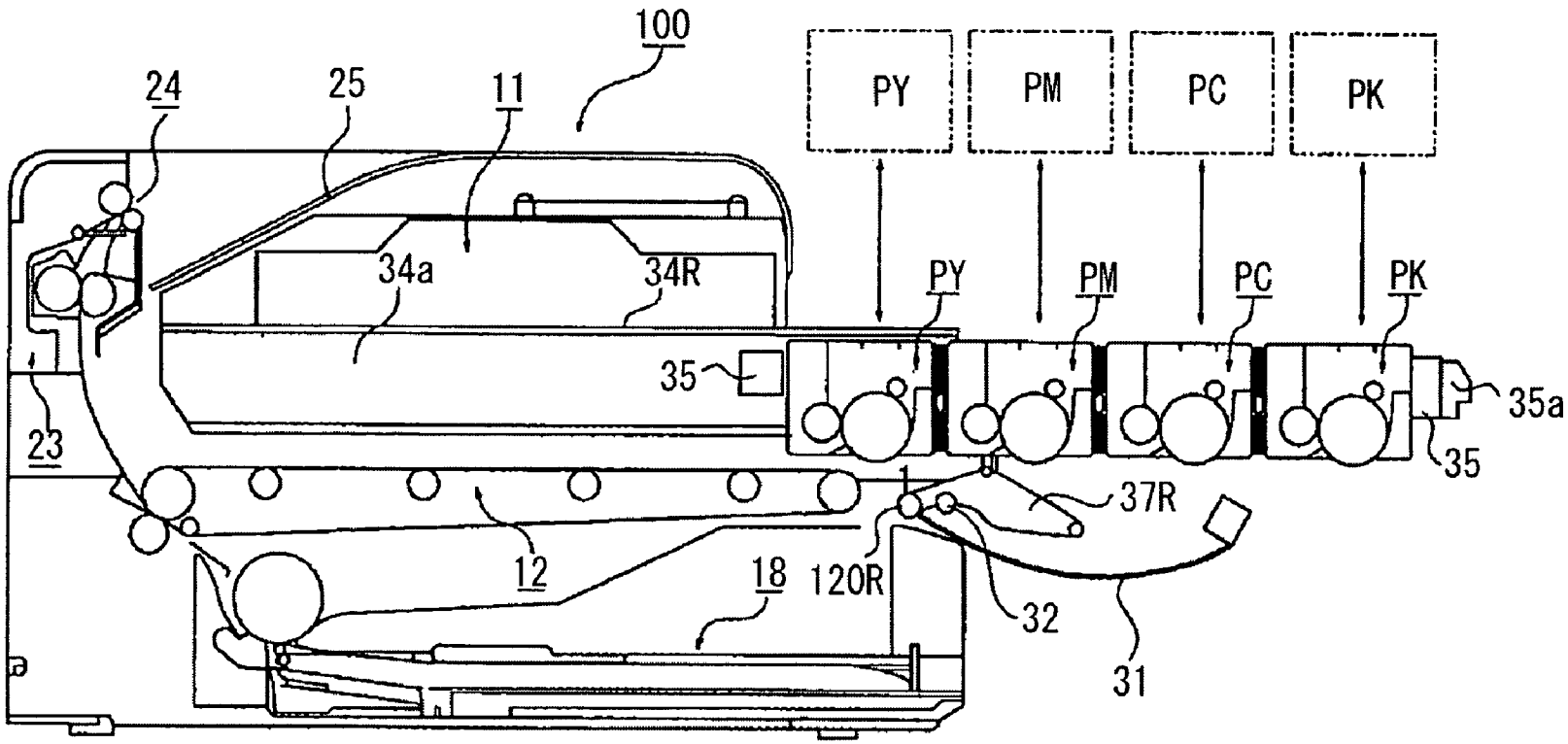
FIG. 6 is a cross-sectional view of the image forming apparatus of FIG. 5.
Figure 19A:
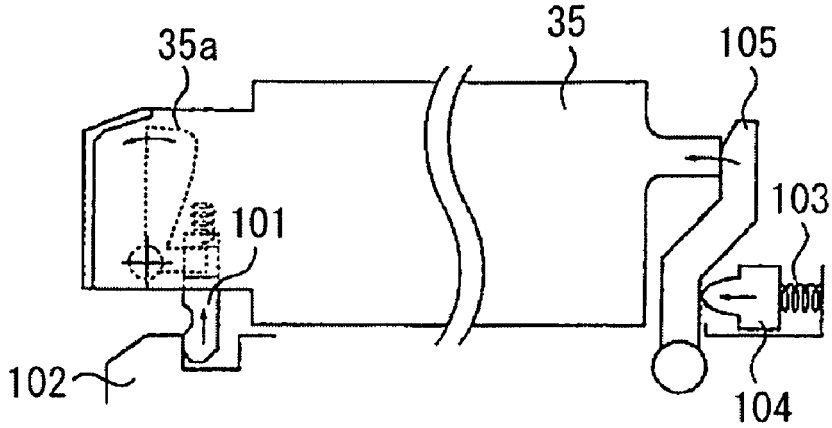
FIGS. 19A and 19B are views illustrating the tray position control unit.
Figure 19B:
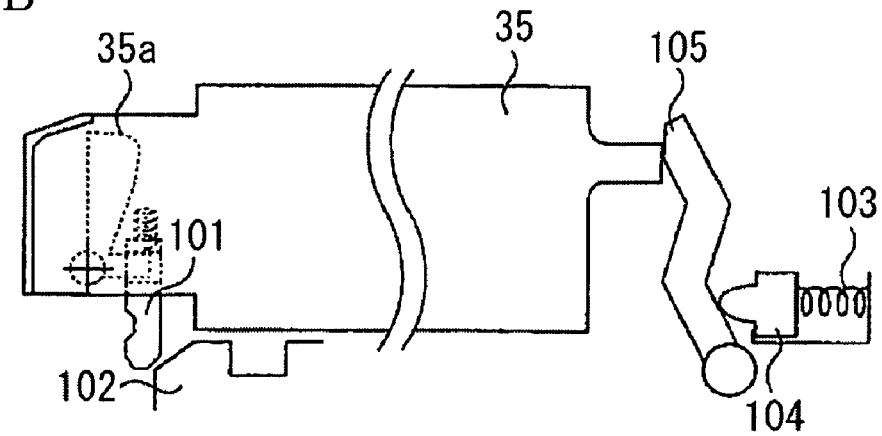

Then, a user grasps a handle portion (movement control releasing unit) 35*a* which is provided on a front frame portion of the cartridge tray and exposed through the opening portion 30 to unclasp a stopper claw (movement control unit) 101 of the cartridge tray 35 from a claw hook portion 102 at the main body side (see FIGS. 19A and 19B). As a consequence, the cartridge tray 35 becomes withdrawable, and the cartridge tray 35 becomes horizontally slidable over the tray holding members 34L and 34R in a forward direction. Thus, the cartridge tray 35 can be sufficiently withdrawn to a predetermined drawn position of the outside of the main body through the opening portion 30 as illustrated in FIGS. 5 and 6.

Accordingly, all of the four process cartridges, i.e., the first through the fourth process cartridges PY, PM, PC and PK, held by the cartridge tray 35 are exposed to the outside of the main body of the apparatus through the opening portion 30, and thereby top surfaces of all of the process cartridges are opened to the user's eyes. When the cartridge tray 35 is withdrawn for a sufficient predetermined distance, a stopper portion (not shown) prevents the cartridge tray from being further withdrawn. Further, the cartridge tray 35 is kept in a state that it is horizontally withdrawn to the predetermined withdrawing position by the tray holding members 34L and 34R.

The cartridge tray 35 supports each process cartridge such that the cartridge can be taken out straightly from above the main body of the apparatus. Further, the cartridge tray 35 supports each process cartridge which was moved straightly downward. Subsequently, a used cartridge to be exchanged is pulled out while it is picked up from the cartridge tray 35 as illustrated in FIG. 6 by a two-dotted line. Then, a new cartridge is inserted into the cartridge tray 35 from the above to place it on the cartridge tray 35. Namely, when the cartridge tray 35 is withdrawn to the outside of the main body, the cartridge can be attached/detached to/from the main body.

In the case of a process cartridge having an openable/closable drum cover (not shown) configured to protect a lower surface of the drum 1, the cover is manually operated into a closed state when the cartridge is taken out from the cartridge tray 35. Further, the new cartridge is manually operated into an open state before it is placed on the cartridge tray 35. Alternatively, the cover is configured such that it automatically performs a closing operation in a process of picking up and withdrawing the cartridge from the cartridge tray 35. On the other hand, the cover is so configured that it automatically performs an opening operation in a process that the cartridge is inserted and placed on the cartridge tray 35.

In the above description, the cartridge tray 35 is movable in a direction perpendicular to a shaft line direction of the drum 1 that the cartridge shows. Further, the cartridge tray 35 can take three positions. That is, a withdrawing position where the cartridge passes through the opening portion 30 and can be attached/detached to/from the tray outside the main body of the apparatus, a loading position for attaching the cartridge to an inside of the main body, and an image forming position where an image can be formed on the drum 1.

The left and the right tray holding members 34L and 34R are a moving unit which serves to move the cartridge tray 35 upwardly from the image forming position before the cartridge is moved to the withdrawing position where the cartridge can be attached/detached to/from the tray or to move the cartridge tray 35 downwardly to the image forming position. In other words, the holding members 34L and 34R are supporting members configured to support the cartridge tray 35, and can take a first position where the cartridge tray 35 is moved between the drawn position and the loading position, and a second position where the cartridge tray 35 is positioned at the image forming position. The tray holding members 34L and 34R move, in association with the closing movement of the door 31, from the first position to the second position.

Figure 7:
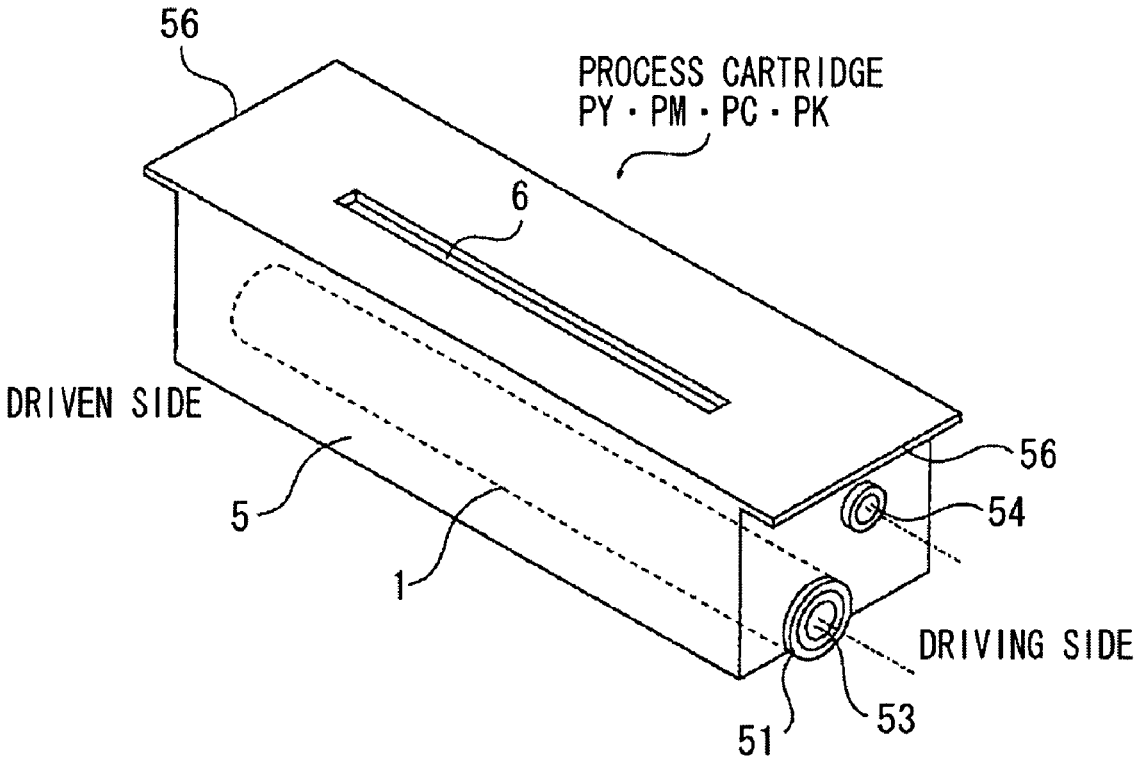
FIG. 7 is a cross-sectional view of a cartridge viewed from a driving side.
Figure 8:
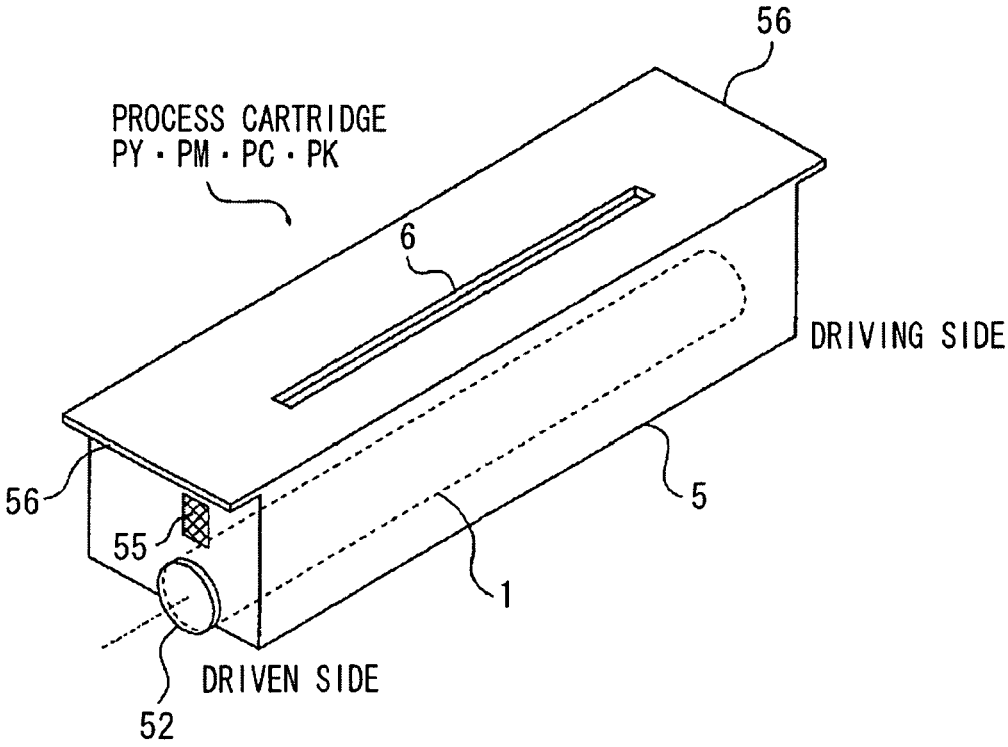
FIG. 8 is a cross-sectional view of the cartridge viewed from a driven side.

FIGS. 7 and 8 are perspective views illustrating an appearance of the cartridge. FIG. 7 is a perspective view of the cartridge viewed from the driving side. FIG. 8 is a perspective view of the cartridge viewed from the driven side.

The cartridge is an assembly having a horizontally longitudinal box shape with the shaft line direction of the drum 1 being a horizontal direction and the horizontal direction is its longitudinal direction. The drum 1 is rotatably supported between bearing portions 51, 52 provided on a right side surface and a left side surface of a cartridge frame member 5, respectively. The right bearing portion 51 includes a coupling fit unit 53 as a drum driving power input portion. Further, the right side surface includes a coupling fit unit 54 as a development driving power input portion for driving the developing roller 3*a*. The left side surface is provided with a cartridge electrical contact 55. The left side surface and the right side surface include an eaves-like portion 56 to which a ceiling board portion of each cartridge frame member 5 is extended in a horizontal direction to project from the left side surface and the right side surface, respectively. In the above cartridge, the right side surface including the coupling fit units 53 and 54 is the driving side, and the left side surface opposing the right side surface is the driven side.

Figure 9:
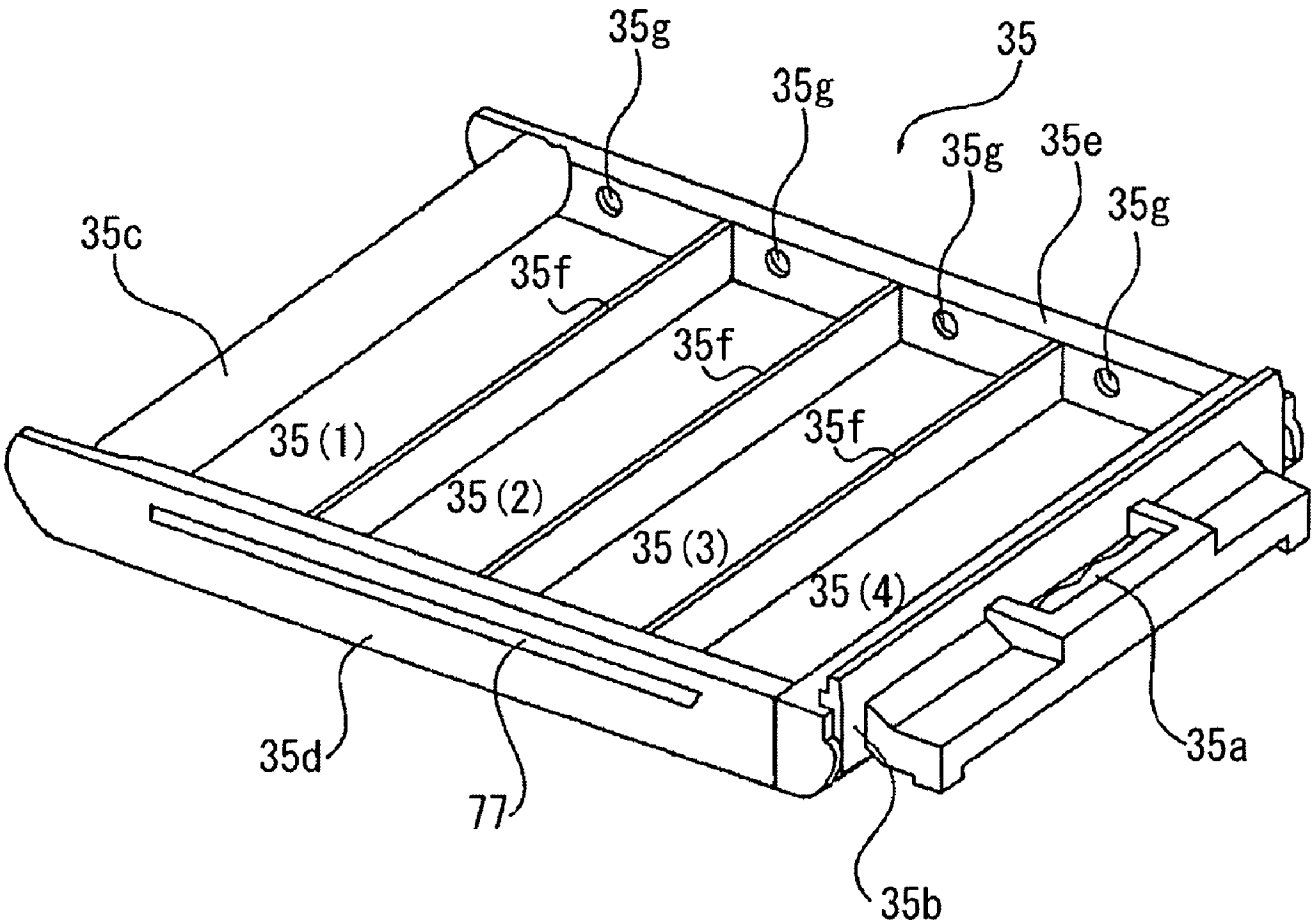
FIG. 9 is a perspective view of a tray.

FIG. 9 is a perspective view illustrating an appearance of the cartridge tray 35. The cartridge tray 35 has a large rectangular frame, and the large frame is divided almost uniformly into four sections by using three pieces of partitions 35*f* to thereby form first to fourth horizontally longitudinal small frame portions 35(1) through 35(4) from a side of a rear frame 35*c* to a side of a front frame 35*b* in this order. Each of the small frame portions 35(1) through 35(4) is configured to hold the four cartridges, i.e., the first through the fourth cartridges PY, PM, PC, PK. A right frame 35*e* of the small frame portions 35(1) through 35(4) includes hole portions 35*g* through which a development driving coupling comes in and out.

Further, the cartridge tray 35 includes intermediate electrical contacts 72*a* through 72*d* (see FIG. 22) which are electrically connected to electrical contacts 55 (see FIG. 8) of the cartridges. These intermediate electrical contacts can be electrically connected to electrical contacts 75*a* through 75*d* (see FIGS. 22 and 23) provided at the main body of the apparatus. This will be described below.

Each cartridge is inserted into the corresponding small frame of the cartridge tray 35, and lower sides of the left and right eaves-like portions 56 of the cartridge are received by top surfaces of the left and the right frames 35*d* and 35*e* of the cartridge tray 35, so that the cartridge is supported by the cartridge tray 35. More specifically, the cartridge tray 35 supports each of the cartridges in a manner they can be taken out directly from above, and each cartridge can be supported by the cartridge tray 35 when the cartridge is moved directly below. The cartridge tray 35 roughly supports each cartridge. With such a configuration, the process cartridge can be exchanged with ease.

Figure 10:
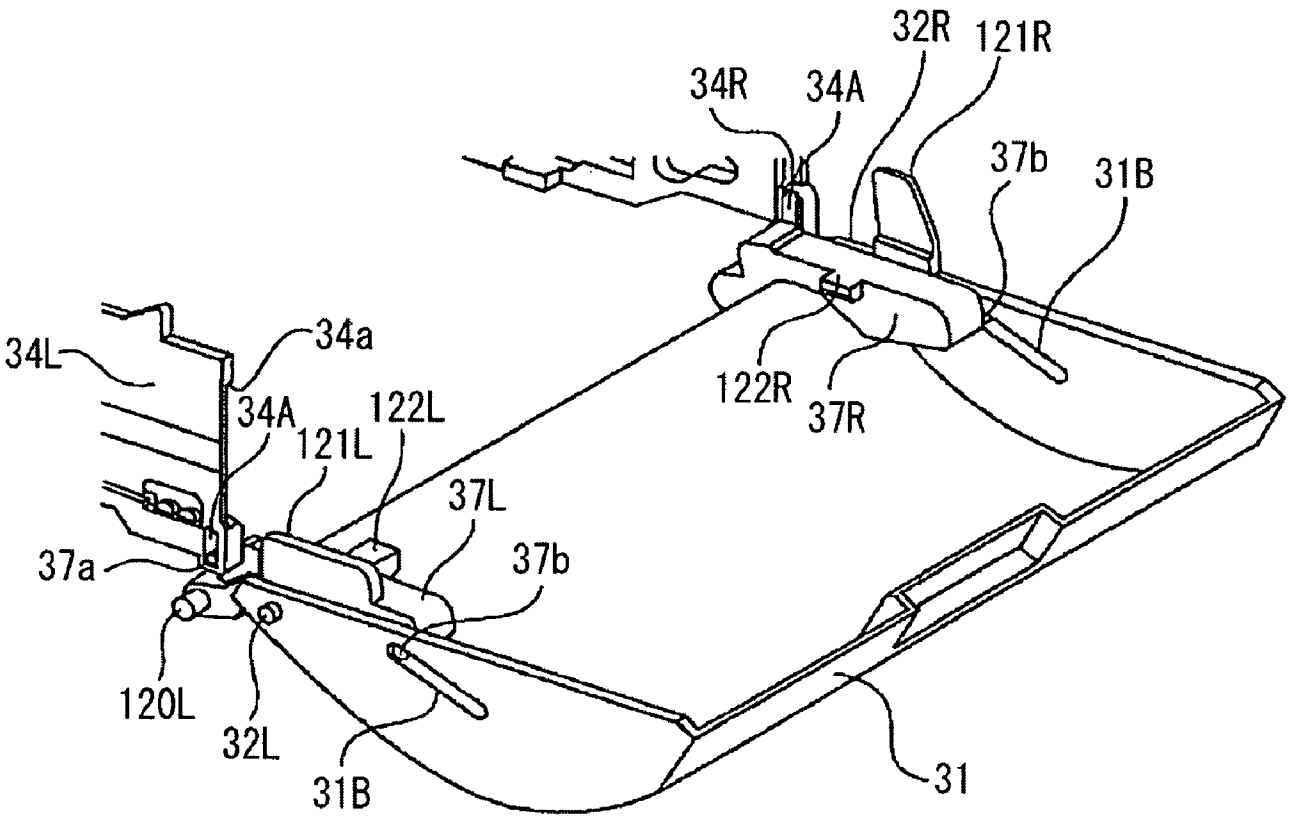
FIG. 10 is a perspective view of an interlocking mechanical system of the door and a tray holding member.
Figure 22:
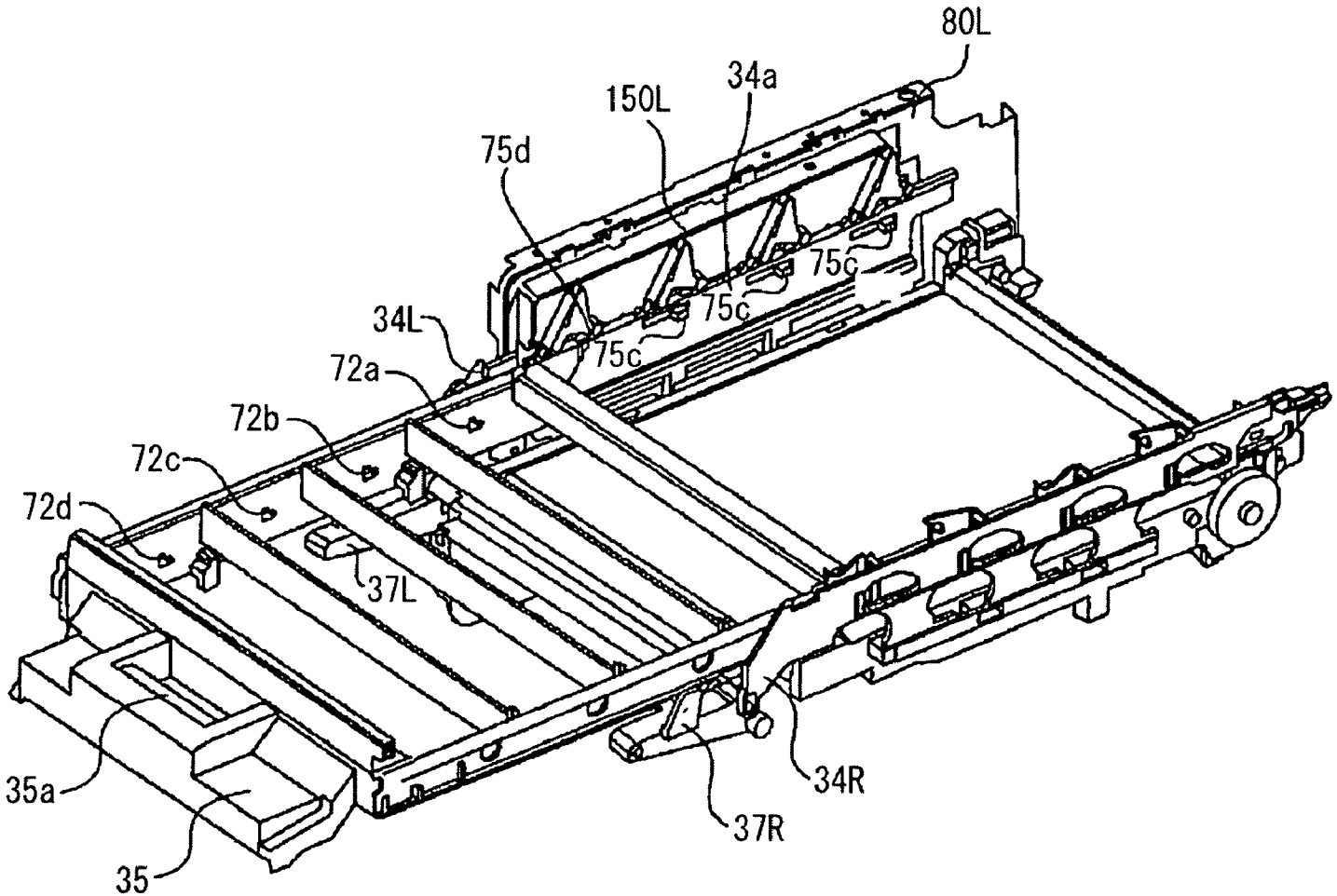
FIG. 22 is a view illustrating a method of feeding the cartridge.

The left and the right frames 35*d* and 35*e* of the cartridge tray 35 is fit into and engaged with the corresponding guide groove portions 34*a* (see FIGS. 6, 10, and 22). The guide groove portions 34*a* are provided inside the left and the right tray holding members 34L, 34R and extended in a longitudinal direction. Accordingly, the cartridge tray 35 is supported between the left and the right tray holding members 34L and 34R and slides over the guide groove portions 34*a* so that the cartridge tray 35 can slide horizontally in a longitudinal direction relative to the tray holding members.

As illustrated in FIGS. 5 and 6, after the cartridge tray 35 is withdrawn and a cartridge to be exchanged among the cartridges held by the cartridge tray 35 is exchanged, the cartridge tray 35 is sufficiently pushed and moved in a reverse direction so as to be contained in the main body of the apparatus, thereby restoring a state before the cartridge tray 35 is withdrawn, i.e., a state illustrated in FIGS. 3 and 4. At the time, the cartridge tray 35 is biased by springs (pressing unit) 103 (see FIG. 19) from a rear side to a front side, which enables the user to securely push back the cartridge tray 35 to the predetermined right position. This will be described below. Then, when the opened door 31 is closed as illustrated in FIGS. 1 and 2, the apparatus is prepared for forming an image.

In association with a closing rotation of the door 31, the tray holding members 34L and 34R move downwardly in a rearward direction for a predetermined distance, so that each cartridge is positioned at an image forming position. Further, in association with the movement of the tray holding members 34L, 34R, each cartridge is pressed by the pressing member to be held in a state secured to a predetermined positioning portion. Thus, a lower surface of the drum 1 of each cartridge contacts a predetermined position of the endless belt 13. The driving power output unit at a side of the main body of the apparatus is coupled to the driving power input unit of the cartridge. The power supply system at a side of the main body is electrically connected to the contacts of the cartridge The door 31, an interlocking mechanical system of the tray holding members 34L, 34R, and the first tray movement control unit will be described below with reference to FIGS. 10 through 15, 17, 18, 21A through 21C, and 23.

FIG. 10 is a perspective view illustrating the door 31 and the interlocking mechanical system of the tray holding members 34L and 34R. The hinge portions 32L and 32R of the door 31 are arranged in a horizontal direction with respect to the main body of the apparatus, and both of left and right ends of the hinge portions are rotatably held between bearing members (not shown) provided at left and right portions of the main body. The left and the right frames 80L and 80R may serve as the bearing members (see FIG. 23). Further, coupling arms 37L and 37R are arranged at positions near the left and the right end portions of the door 31, respectively. Hinge portions 120L, 120R of the coupling arms 37L and 37R are arranged in a horizontal direction relative to the main body, and are rotatably supported relative to bearing members (not shown) provided at left and right portions of the main body. The left and the right frames 80L, 80R may serve as bearing members. The coupling arms 37L, 37R include lateral shafts 37*a*, 37*b*, respectively. The lateral shaft 37*a* of the left coupling arm 37L is fit into and engaged with longitudinal long holes 34A provided in a lower portion of the front side in the tray holding member 34L of the left side. On the other hand, the lateral shaft 37*b* is fit into and engaged with the groove 31B provided on a left side surface of the door 31. Further, the lateral shaft 37*a* of the right coupling arm 37R is fit into and engaged with the longitudinal long hole 34A provided in a lower portion of the front side in the tray holding member 34R, while the lateral shaft 37*b* is fit into and engaged with a groove 31B provided on a right side surface of the door 31.

As described above, the door 31 and the tray holding members 34L and 34R are coupled to each other though the coupling arms 37L and 37R, the lateral shafts 37*a* and 37*b*, the longitudinal long holes 34A, and the grooves 31B. Accordingly, when opening/closing the door 31, the left and a moving force acts on the right tray holding members 34L and 34R in a longitudinal direction. At this time, the hinge portions 120L and 120R of the coupling arms 37L and 37R may reside on the same shaft as the hinge portions 32L and 32R of the door 31. Further, the door 31 and the moving units 34L, 34R may be directly coupled to each other without the coupling arms 37L, 37R.

Two pin shafts 34*c* implanted on the left and the right tray holding members 34L and 34R at an interval in a longitudinal direction are fit into guide holes 36 provided respectively on the left and the right frames 80L and 80R of the main frame of the main body of the apparatus. According to the fitting between the pin shafts 34*c* and the guide holes 36, the tray holding members 34L and 34R are supported by the left and the right frames 80L and 80R, respectively.

Figure 11A:
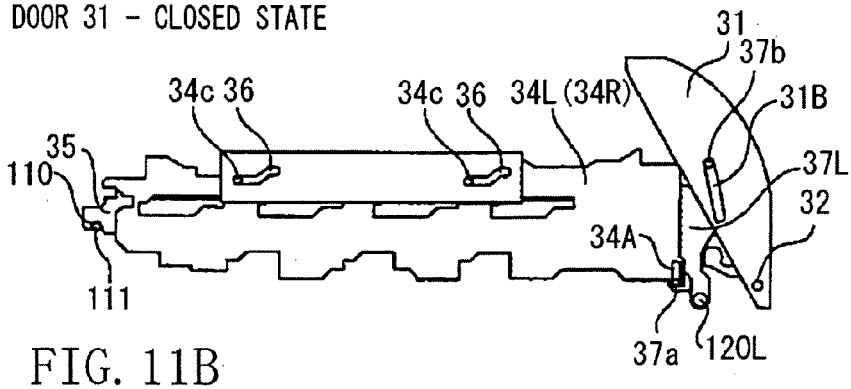
FIGS. 11A through 11C illustrate a movement of the tray holding member in association with an opening rotation of the door.
Figure 11B:
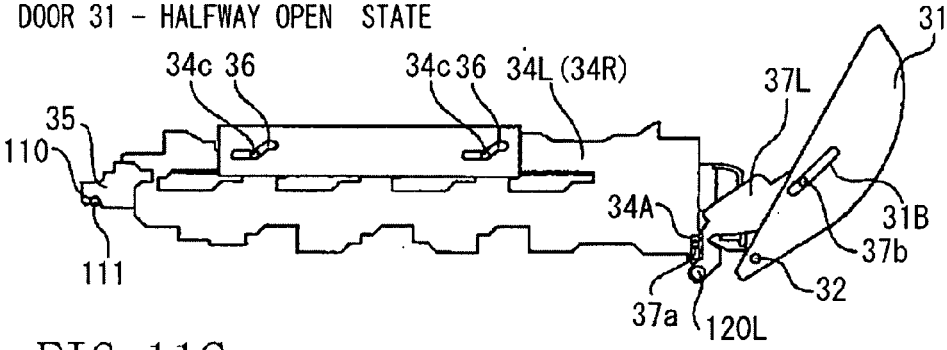
Figure 11C:
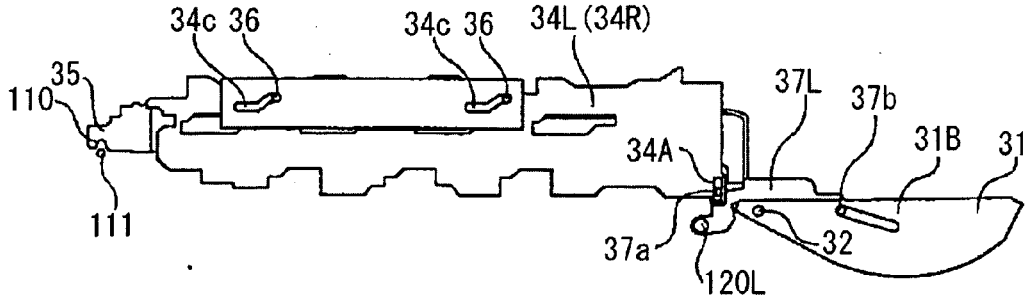

FIGS. 11A through 11C illustrate two pin shafts 34*c* and the guide holes 36 with respect to the left tray holding member 34L. Although the right tray holding member 34R is not illustrated here, it has the same configuration as that of the left tray holding member 34L, and the pin shafts 34*c* and the guide holes 36 of the holding member 34R are symmetrically formed to the left tray holding member 34L.

Therefore, each of the left and the right tray holding members 34L, 34R can freely move within a guiding range of the guide holes 36 relative to the left frame 80L and the right frame 80R.

Figure 12:
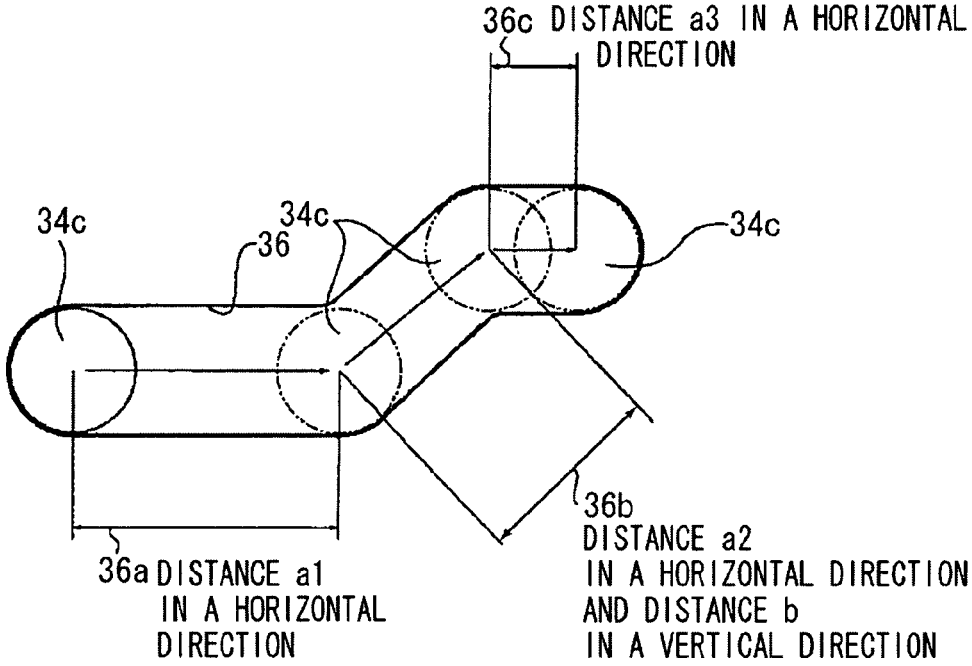
FIG. 12 is an enlarged view of a guide hole unit.

FIG. 12 is an enlarged view of the guide hole 36. Each of the guide holes 36 has a horizontal first guide area 36*a* in a longitudinal direction, and an inclined second guide area 36*b* which is continuous with the first guide area 36*a* in a pin shaft advancing direction. Further, each of the guide holes 36 has a third guide area 36*c* which is continuous with a top portion of the second guide area 36*b* and which receives the pin shaft 34*c* to hold it securely.

After the pin shafts 34*c*, i.e., the left and the right tray holding members 34L, 34R, move in association with the opening rotation of the door 31 for a distance a1 in a horizontal direction according to the first guide area 36*a*, the pin shafts 34*c* further move obliquely upward (a distance a2 in the horizontal direction and a distance b in a vertical direction) according to the second guide area 36*b*. Then, the pin shafts 34*c* finally move in the horizontal direction for a distance a3 according to the third guide area 36*c*.

FIG. 11A illustrates a state that the door 31 is completely closed with respect to the main body of the apparatus. In this state, the left and the right tray holding members 34L and 34R are moved in a rearward direction within the main body through the hinge shafts 32, the coupling arms 37L and 37R, the lateral shafts 37*a*, and the longitudinal long holes 34A. The pin shafts 34*c* are positioned at rear ends of the first guide areas 36*a* of the guide holes 36. Therefore, the left and the right tray holding members 34L and 34R are held at a predetermined lowered position (second position) relative to the left frame 80L and the right frame 80R correspondingly. As a result, the cartridge tray 35 held by the tray holding members 34L, 34R is also held at a predetermined lowered position (image forming position).

The cartridges PY, PM, PC and PK held by the cartridge tray 35 are pressed by the pressing members at the left and the right top surfaces thereof. Accordingly, lower surfaces (portions to be positioned) of the bearing portion 51 at the driving side and the bearing portion 52 at the driven side are secured to the positioning portions provided on the positioning portion members (inside plates) of the main body of the apparatus. Thus, each cartridge is held in a predetermined positioning state with respect to the main body. In this state, the lower surface of each cartridge stably contacts a top surface of an upstream side belt portion of the belt unit 12. At this time, the drum driving coupling and the development driving coupling at the side of the main body are fit into the coupling fit units 53, 54 of each cartridge, respectively. Further, the electrical contacts 55 are placed in a state that power can be supplied from the side of the main body through the intermediate electrical contacts.

A right side of the cartridge tray 35 includes a downwardly facing lower end of a U-shaped groove 110 provided on the cartridge tray 35. The U-shaped groove 110 is engaged with and positioned by a pin 111 that is a stable member provided on the right frame 80R of the main body of the apparatus (see FIG. 23). A left side of the cartridge tray 35 includes downwardly extending projecting portions 67 provided on the cartridge tray 35 (see FIGS. 17, 18, and 21). A lower end of the projecting portions 67 is engaged with and positioned by holes 69 provided in the stable member 68 of the main body side. The positioning unit of the cartridge tray 35 may be either one of the left or the right one of the above-described units.

FIG. 11B illustrates a state that the door 31 is halfway open. When the door 31 is gradually opened from its closed state of FIG. 11A, the left and the right tray holding members 34L and 34R are pulled in a forward direction within the main body of the apparatus in association with the opening movement of the door 31. Accordingly, the tray holding members 34L, 34R are initially moved horizontally in a forward direction for a distance a1 as the pin shafts 34*c* are guided by the first guide area 36*a* of the guide holes 36. FIG. 11B illustrates the above-described state. In the process of moving the tray holding members 34L and 34R for the distance a1, the drum driving coupling and the development driving coupling with respect to each cartridge is released. Further, the positioning by the pressing member of each cartridge is also released. Here, the pin 111 provided on the right frame 80R is fit into the U-shaped groove 110 provided on the cartridge tray 35 to be positioned therein such that the cartridge tray 35 does not move following the movement of the tray holding members 34L and 34R. Further, the lower ends of the downwardly facing projecting portions 67 provided on the tray 35 are fit into the holes 69 provided in the stable member 68 of the main body side to be positioned therein.

In association with a continuous opening rotation of the door 31, the tray holding members 34L and 34R are further pulled in the forward direction within the main body of the apparatus. Accordingly, the tray holding members 34L and 34R move obliquely upward as the pin shafts 34*c* are guided in the second guide areas 36*b* of the guide holes 36. In the process of obliquely upward movement of the tray holding members 34L, 34R, the electrical contacts 55 of each cartridge are shut from the main body.

Figure 13:
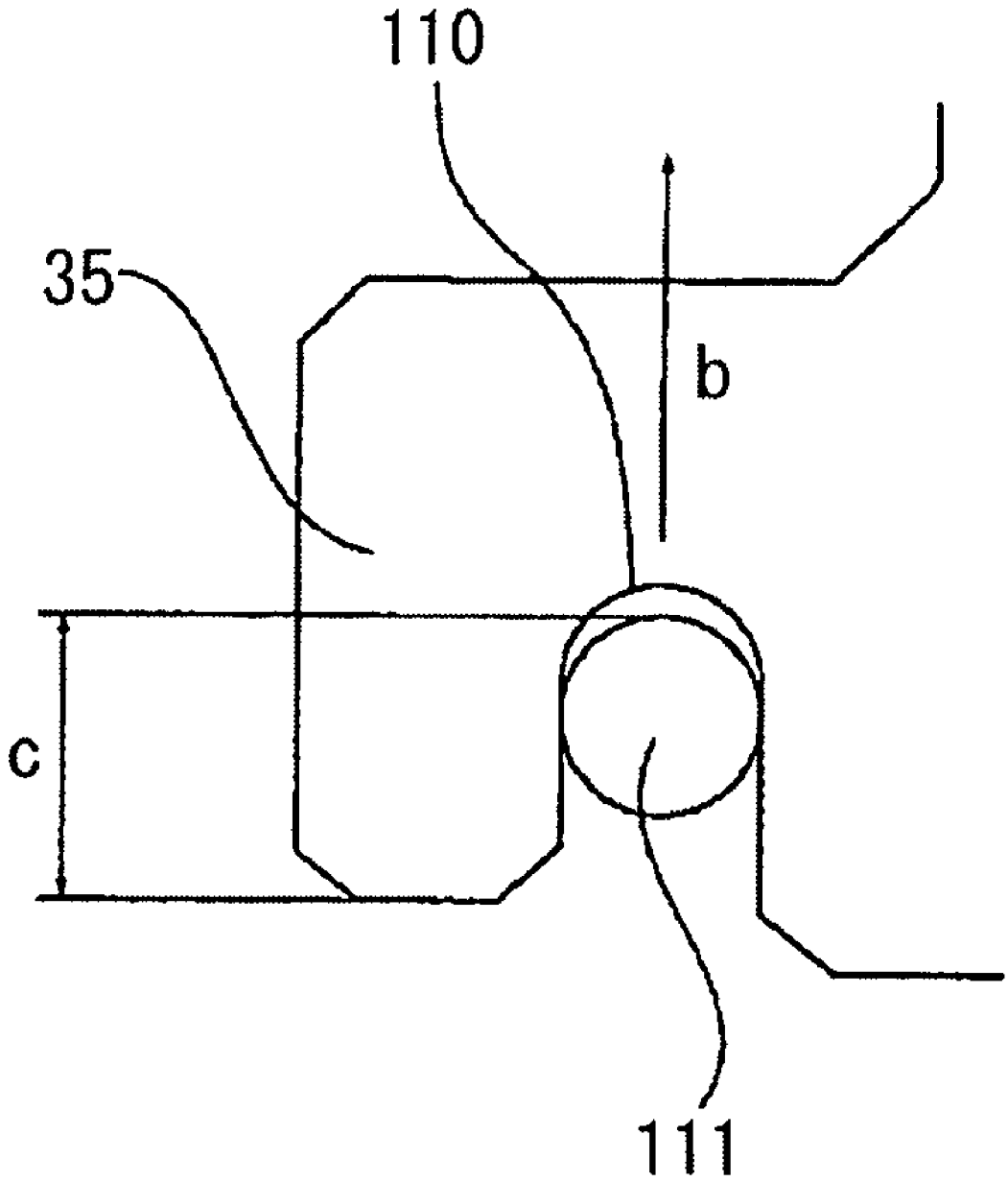
FIG. 13 is an enlarged view of a pin and a U-shaped groove unit.

Here, the advancing amount of the pin 111 into the U-shaped groove 110 is indicated by a distance c as illustrated in FIG. 13. Further, the moving amount of the U-shaped groove 110 rising upward in association with the obliquely upward movement of the tray holding members 34L and 34R which hold the cartridge tray 35 is indicated by a distance b. When the tray holding members 34L and 34R move obliquely upward, the U-shaped groove 110 of the cartridge tray 35 moves following the movement of the tray holding members 34L and 34R only in the vertical direction while the pin 111 engages with the U-shaped groove 110 of the tray 35 ($c>b$). Then, when the tray holding members 34L and 34R is raised to some extent ($c \leqq b$), the pin 111 is detached from the U-shaped groove 110. With such a configuration, when the lower surface of the drum of the cartridges PY, PM, PC and PK held by the cartridge tray 35 contacts the endless belt 13, the cartridge tray 35 does not move in a horizontal direction. Therefore, the drum 1 and the endless belt 13 are prevented from being damaged by friction or the memory cannot be generated. The projecting portions 67 at a left side of the cartridge tray 35 and the advancing distance of the holes 69 defined in the stable member 68 may be configured similar to what is described above.

FIG. 11C illustrates a state that the door 31 is completely open. In this state, the tray holding members 34L and 34R has finished moving in the obliquely upward direction according to the second guide areas 36*b*, and the pin shafts 34*c* are positioned in the horizontal third guide areas 36*c*. In other words, after the tray holding members 34L and 34R move obliquely upward, they move in the horizontal direction. This movement is performed to make the positions of the cartridges and the tray holding members stable in a height direction and to prevent the tray holding members from retracting to an original position when the cartridges are later exchanged by withdrawing the cartridge tray 35 from the tray holding members 34L, 34R.

In a state as illustrated in FIG. 11C, the pin 111 is dropped out from the U-shaped groove 110, and the projecting portions 67 also come off the holes 69, and thus the cartridge tray 35 is released from the positioning state. Therefore, the cartridge tray 35 can freely horizontally slide in a longitudinal direction relative to the tray holding members 34L, 34R.

In the above configuration, the groove 110, the pin 111, the projections 67, and the holes 69 constitute the first movement control unit configured to perform control such that the tray 35 as the moving member does not move in a direction perpendicular to a direction that the drum 1 of the cartridge and the endless belt 13 contact each other at the loading position within the main body of the apparatus. The movement control of the cartridge tray 35 by the movement control units 110, 111, 67 and 69 is released after the cartridge tray 35 moves following the movement in a direction of a component that the left and the right tray holding members 34L and 34R as the moving unit contact the endless belt 13.

The left and the right tray holding members 34L and 34R as the moving unit are guided by the first guide areas 36*a* to move in a direction perpendicular to the direction that the drum 1 of the cartridge contacts the endless belt 13 (first movement). Then, the tray holding members 34L and 34R are guided by the first guide areas 36*a* to move in an oblique direction having two components of the direction. That is, a direction that the drum 1 contacts the endless belt 13 and the direction perpendicular to the contacting direction (second movement). The tray holding members 34L and 34R subsequently move in a direction perpendicular to the direction that the drum 1 contacts the endless belt 13 (third movement). Thereafter, the tray holding members 34L and 34R cut driving of the cartridge in the first movement, and, after the cartridge tray 35 moves following the movement of a component of the direction that the drum 1 contacts the endless belt 13, the first movement control units 110, 111, 67 and 69 are released.

In this state, the cartridge tray 35 horizontally slides in a longitudinal direction relative to the tray holding members 34L and 34R and takes a withdrawing position where the process cartridges are exchangeable and a loading position for installing the process cartridges into the inside of the main body of the apparatus. The second movement control unit configured to position the cartridge tray 35 at a loading position will be described below.

Figure 15:
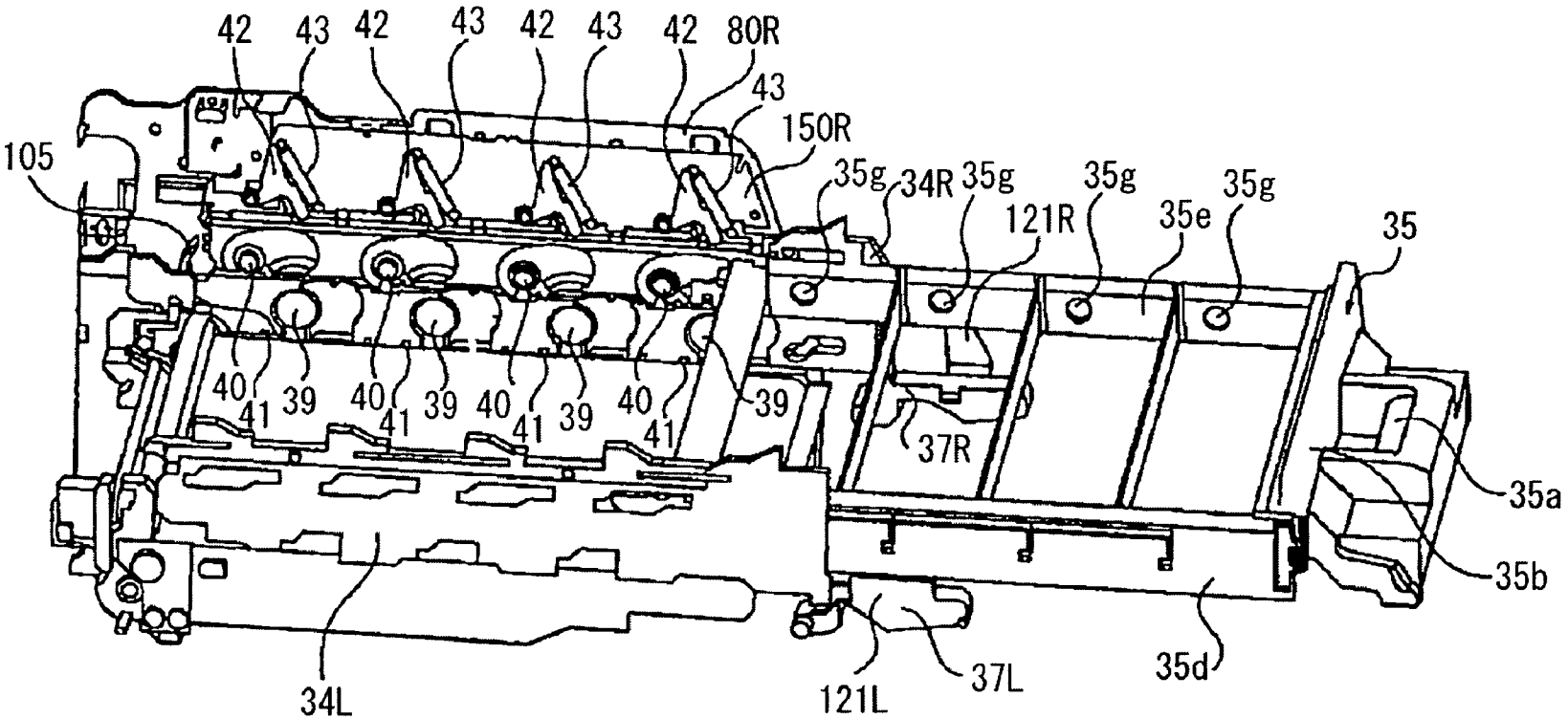
FIG. 15 is a view illustrating the interface section disposed around the cartridge, the interface unit being released in association with the tray holding member.

FIG. 15 is a perspective view illustrating a state that the cartridge tray 35 is withdrawn to a position where the cartridge is exchangeable. At this time, the cartridge tray 35 that largely projects from the main body of the image forming apparatus 100 can be supported by supporting portions 121L and 121R of the coupling arms 37L and 37R. With the above configuration, a front side of a main body of the cartridge tray 35 is prevented from extremely bending downwardly due to the own weight of the cartridge tray 35 or the process cartridge. Thus, a surface of the drum 1 is prevented from being scratched by the tray. Further, the main body which becomes unbalanced due to the withdrawal of the cartridge tray 35 is prevented from falling down.

Since the coupling arms 37L and 37R rotate in association with the door 31, it is possible to position the supporting portions 121L and 121R of the coupling arms 37L and 37R within the main body of the apparatus when the door 31 is closed, and to position the supporting portions 121L and 121R of the coupling arms 37L and 37R outside the main body when the door 31 is open. Accordingly, the cartridge 35 can be stably held at the withdrawing position, and thus the usability at the time of exchanging a cartridge can be enhanced without increasing the size of the main body.

At this time, shapes and the number of fulcrums of the supporting portions 121L and 121R configured to support the cartridge tray 35 at the withdrawing position are not limited to those as illustrated in FIG. 15. Further, the supporting portion of the cartridge tray 35 may be provided integrally on the door 31.

As described above, the cartridge is placed on the moving member (tray) for the purpose of enhancement of usability, to exchange the cartridge and move the moving member in an up-and-down direction in association with the movement of the moving unit (tray holding members) in a vertical component of a direction. The moving unit moves in association with the opening/closing rotation of the door, and supports the moving member at the withdrawing position in front of the main body by the coupling portions (coupling arms). Thus, an image forming apparatus configured to exchange a process cartridge by a withdrawing method can be provided. In this image forming apparatus, the scratches caused by the friction between the belt and the cartridge can be prevented or the memory cannot be generated without increasing cost and the size of the main body.

An interface unit will be described with reference to FIGS. 1, 2, 5 through 7, 14 through 16A and 16B, 25A, and 25B.

FIGS. 14 through 16A, and 16B are views illustrating an interface unit around the cartridge which is moved and released in association with the tray holding members 34L and 34R.

Figure 14:
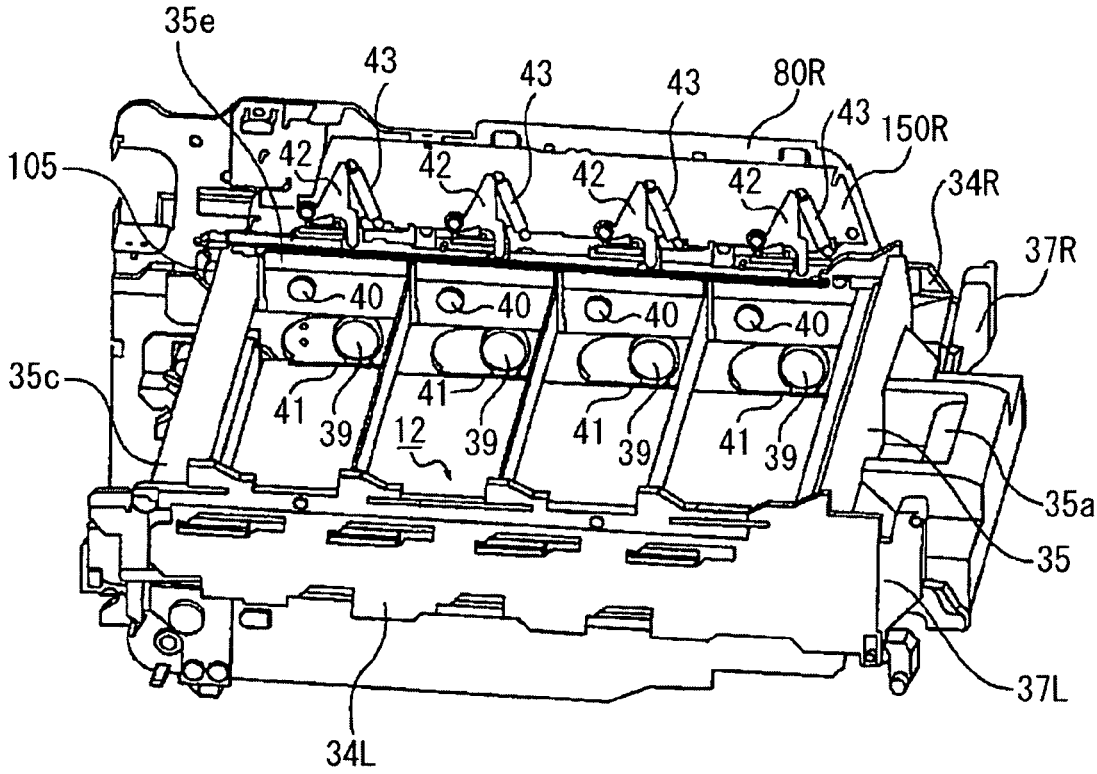
FIG. 14 is a view illustrating an interface section disposed around the cartridge, in which the interface section is released in association with the tray holding member.

FIG. 14 illustrates a state that the door 31 of FIGS. 1 and 2 is closed in which no cartridge is present. FIG. 15 illustrates a state that the cartridge tray 35 is withdrawn while the door 31 of FIGS. 5 and 6 are open.

The developing roller 3*a*, drum drive couplings 39 and developing drive couplings 40 are provided at the right side of the main body of the apparatus as the driving power output portion coupled with the driving power input units 53 and 54 on the cartridge side (see FIG. 7). The developing roller 3*a*, drum drive couplings 39 and developing drive couplings 40 are configured to rotatably drive the drum 1 of each cartridge.

Figure 25A:
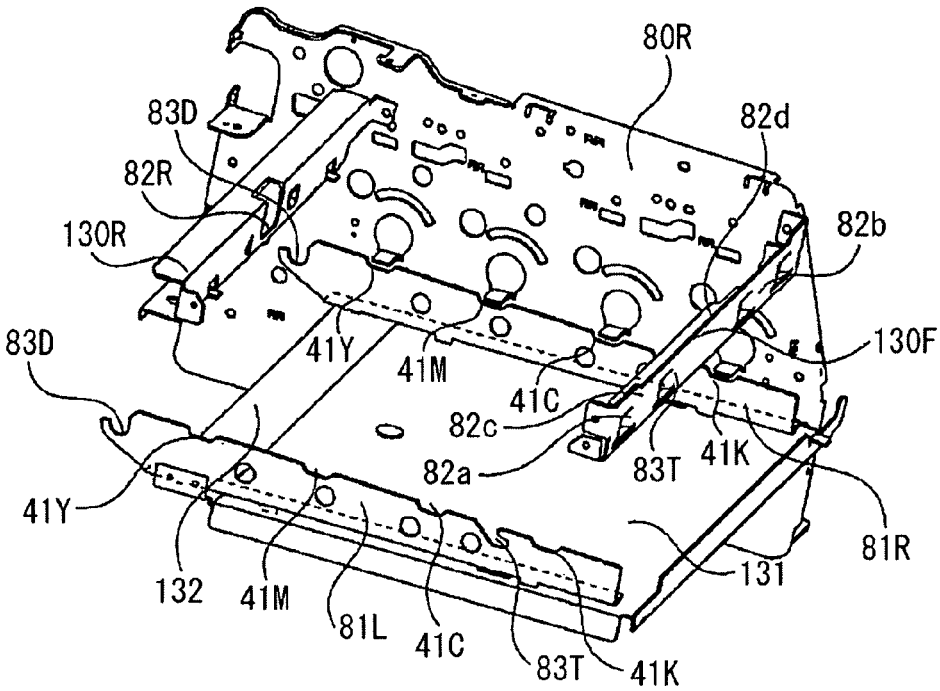
FIGS. 25A and 25B are views illustrating a configuration of a stay member and a positioning member.
Figure 25B:
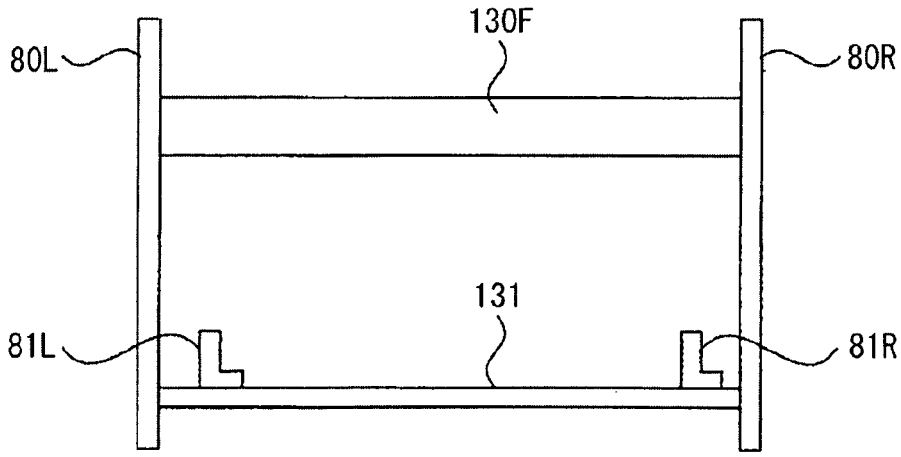
Figure 26:
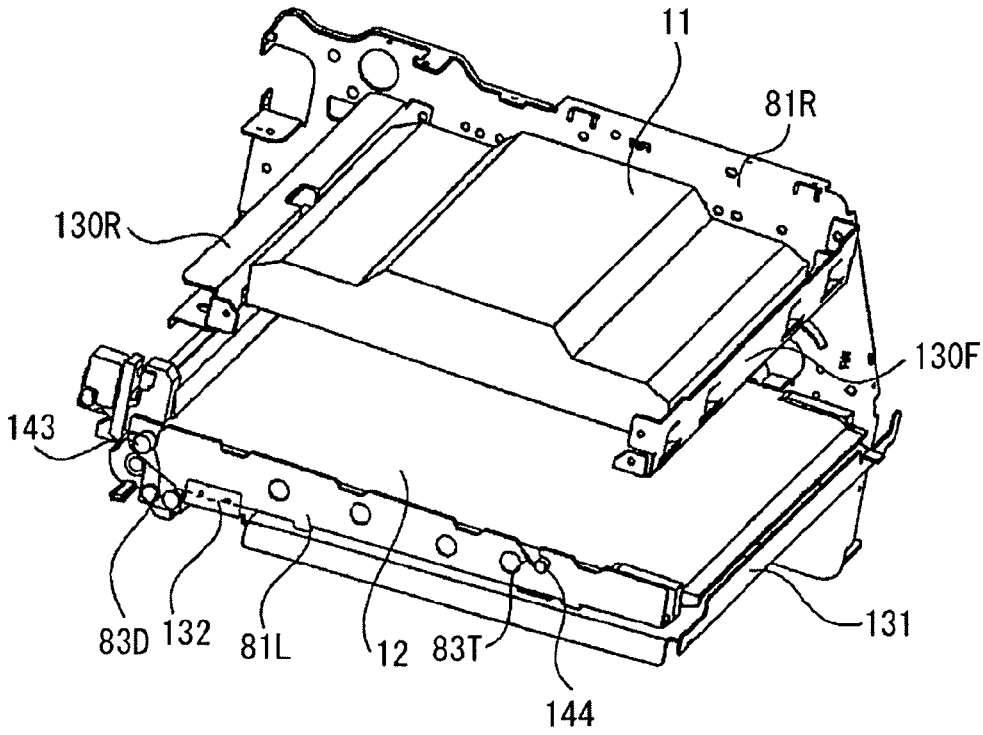
FIG. 26 is a view illustrating a configuration of the stay member.
Figure 27:
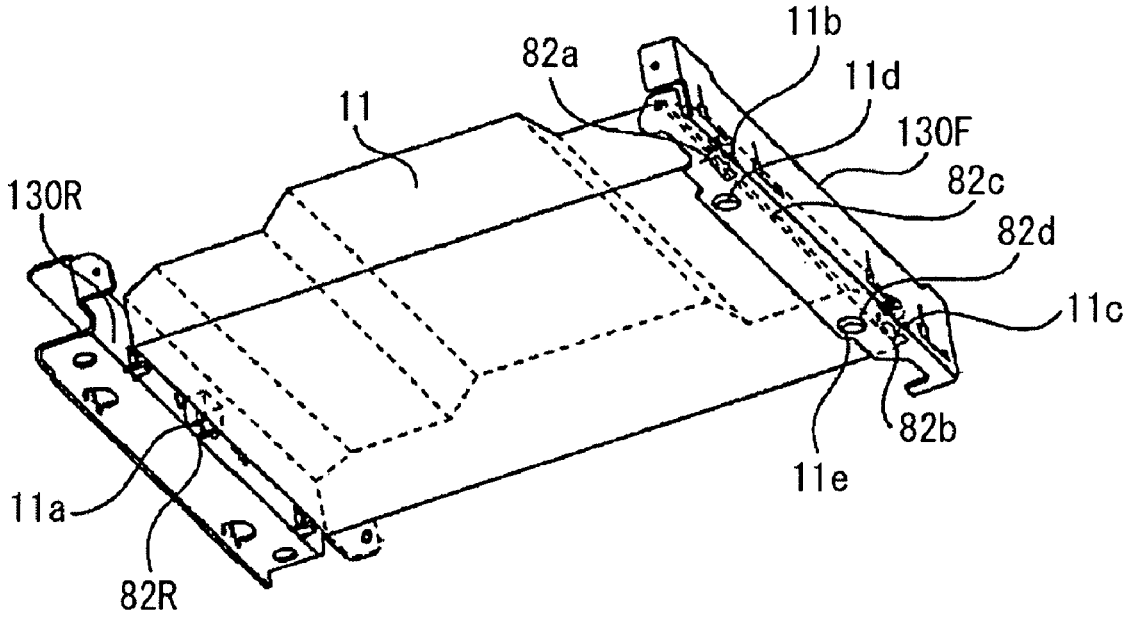
FIG. 27 is a view illustrating a configuration of the stay member.

Further, at both of the right side and the left side of the main body of the apparatus, positioning portions 41 configured to receive a lower surface portion of the bearing portion 51 at the driving side of each cartridge and a lower surface portion of the bearing portion 52 at the driven side of each cartridge are provided on the left and the right positioning members 81L and 81R (see FIGS. 25A and 25B). At the right side and the left side of the main body, pressing members 42 configured to press each of a left side top surface and a right side top surface of the cartridge are provided. The pressing members 42 are supported by members 150R and 150L. The bearing portion 51 of the driving side and the bearing portion 52 of the driven side are fit into the positioning portions 41 by the pressing members 42 so as to be secured therein. In the pressing members 42, the pressing springs 43 are provided to generate a pressing force.

Figure 16B:
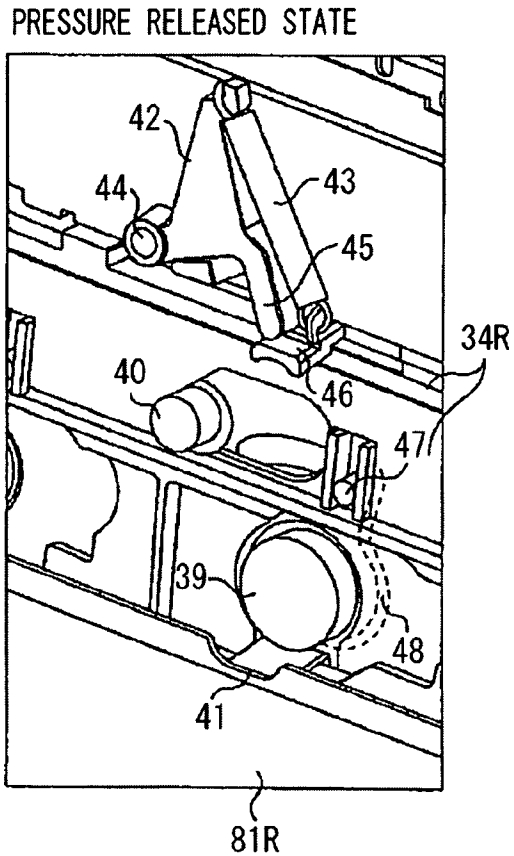
FIGS. 16A and 16B are views illustrating the interface section disposed around the cartridge, in which the interface section is released in association with the tray holding member.
Figure 16A:
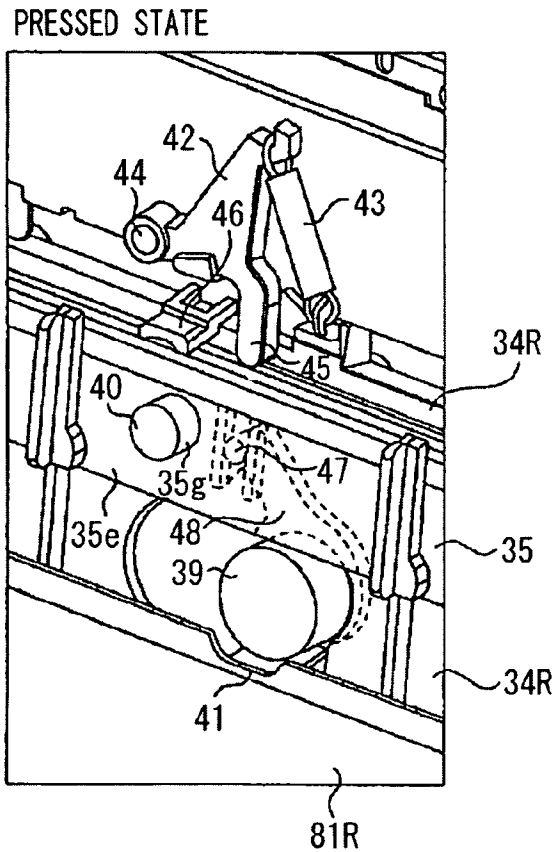

FIG. 16A is an enlarged view illustrating portions of the pressing member 42, the drum drive coupling 39, and the developing drive coupling 40 of FIG. 14. FIG. 16B is an enlarged view illustrating portions of the pressing member 42, the drum drive coupling 39, and the developing drive coupling 40 of FIG. 15.

Each pressing member 42 is provided in an main body of the apparatus so as to be rotatable around a supporting point 44, and presses the top surfaces of the left and the right side ends of the cartridge by a spring force of the pressing spring 43 using a pressing member lever 45. In a pressure released state of FIG. 16B, a pressing member pushing portion 46 provided on the tray holding member 34R presses up the pressing member lever 45 to release a pressure exerted on the cartridge according to the movement of the tray holing member 34R.

Further, a release lever pin 47 is provided on each release lever 48 (a drive cut unit configured to cut off the driving of the cartridge) arranged at a center of the coupling in order to move the drum drive coupling 39 backwardly. Then, in association with the movement of the tray holding member 34R, the release lever pin 47 moves from a position of FIG. 16A to a position of FIG. 16B. According to the operation of the release lever 48, the drum drive coupling 39 and the developing drive coupling 40 move backwardly to the position of FIG. 16B. More specifically, the drum drive coupling and the developing drive coupling are released with respect to each cartridge.

In the state of FIG. 15, namely, in a state that the drum drive coupling 39, the developing drive coupling 40, and the pressing member 42 are released according to the movement of the tray holding members 34R and 34L, the cartridge tray 35 becomes freely slidable. Therefore, the cartridge tray 35 can be withdrawn from the main body of the apparatus with the cartridge placed thereon, and thus the cartridge tray is prepared to be contained into the main body.

Thus, the left and the right tray holding members 34R, 34L operate in association with the opening/closing movement of the door 31. In this case, it is useful that releasing timings of the pressuring and the driving are slightly differentiated in order to alleviate the opening and closing forces of the door 31. That is, the releasing timings of the drum drive couplings 39, the developing drive couplings 40, and the pressing members 42 are slightly differentiated to each other. More specifically, positions of the release lever pin 47 and the pressing member pushing portions 46 are moved to slightly differentiate the timings of releasing the driving force and the pressure, and further the timings of releasing the driving force and the pressure between the process cartridges, so that a load on the door 31 is dispersed. Thus, the force at the peak is reduced and therefore, the user's operating load can be decreased when the user operates the door 31.

As described above, the movement of the tray holding members 34R and 34L causes a backward movement of the driving unit (couplings 39 and 40) and the up-and-down movement of the tray, so that consolidation of the mechanism and down-sizing of the main body can be achieved.

A second tray position control unit will be described below with reference to FIGS. 11A through 11C, 13, and 17 through 21C.

Figure 17:
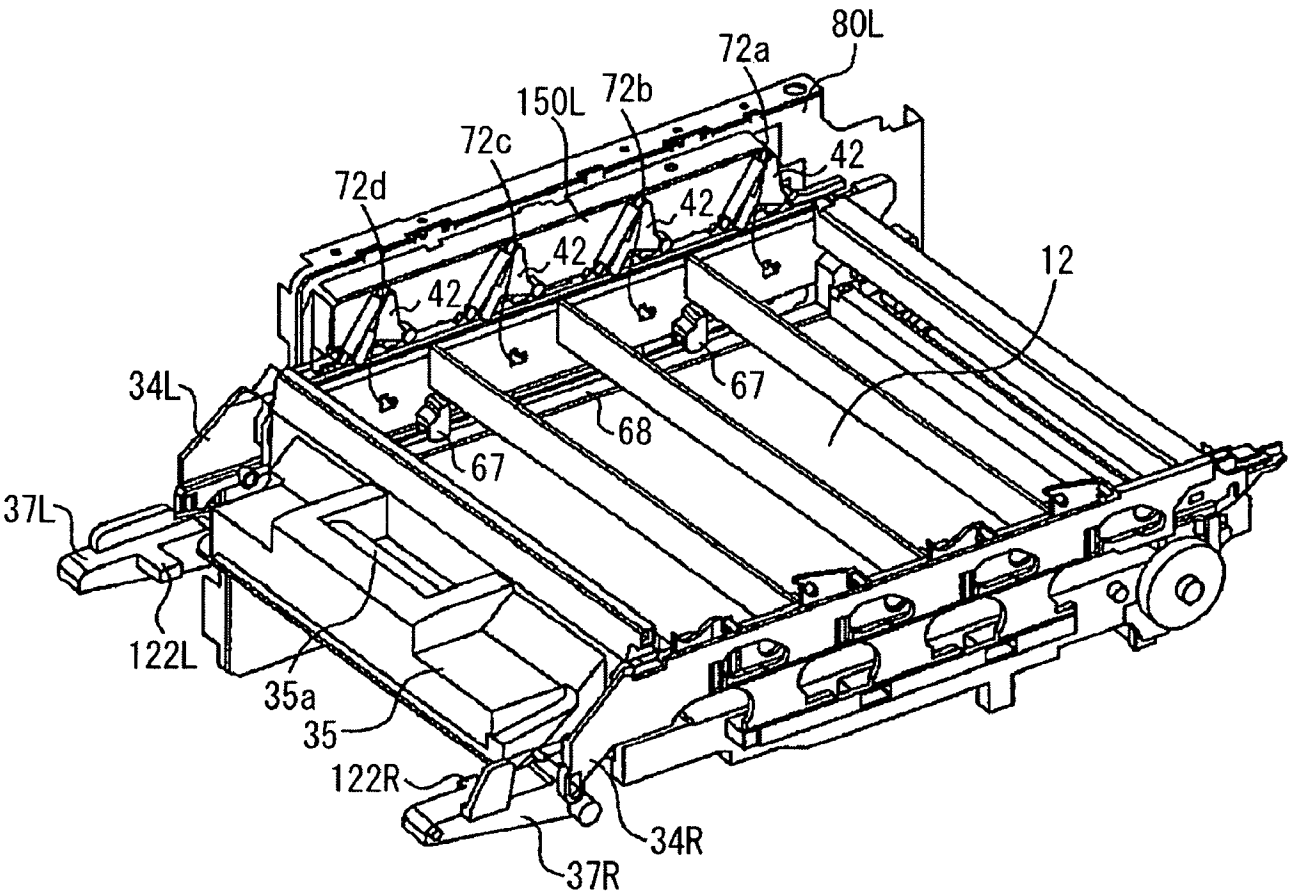
FIG. 17 is a view illustrating a tray position control unit.
Figure 18:
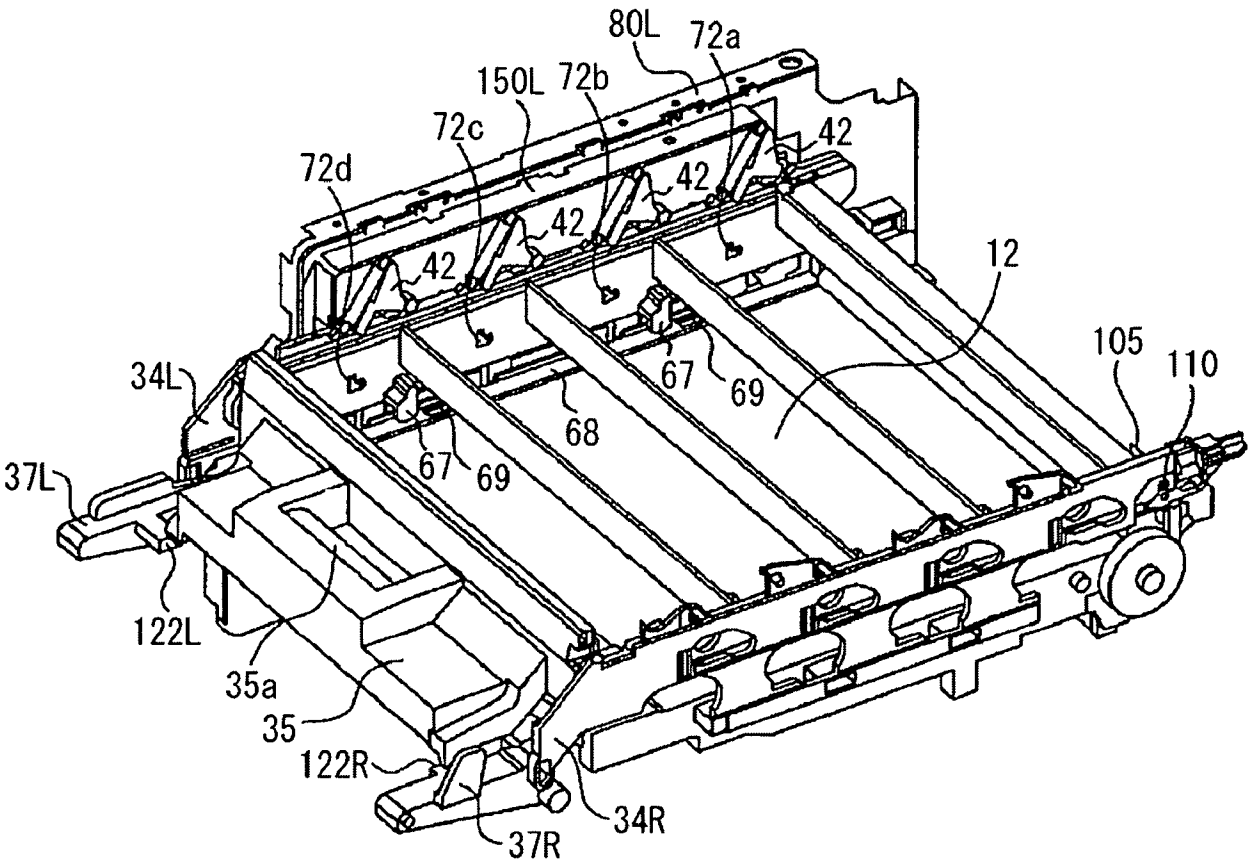
FIG. 18 is a view illustrating the tray position control unit.

FIG. 17 illustrates a state that the cartridge tray 35 is completely retracted to a loading position of the main body of the apparatus. FIG. 18 illustrates a state that a door 31 is open, and the tray holding members 34R and 34L and the cartridge tray 35 are pushed up, i.e., a state that the cartridge tray 35 is not completely contained within the main body. FIGS. 19A and 19B are views illustrating an operation of the second movement control unit configured to lead the cartridge tray 35 to the completely loaded position.

Figure 20A:
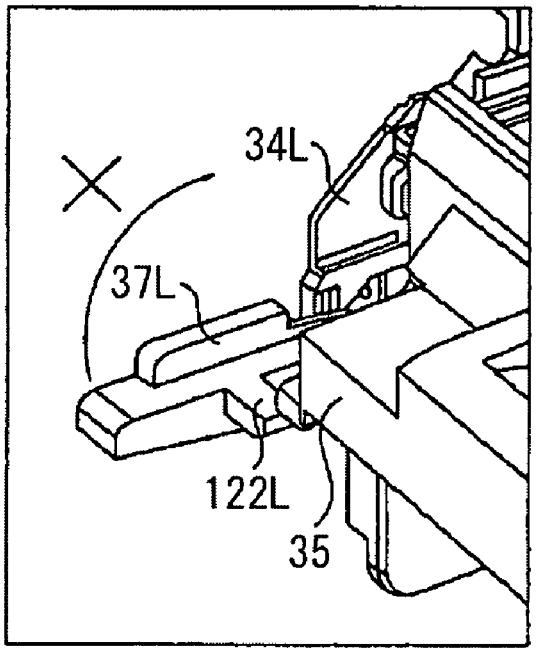
FIGS. 20A and 20B are views illustrating the tray position control unit.

In the state of FIG. 18 that the cartridge tray 35 is not sufficiently pushed into a right position, the projecting portions 122L, 122R of the coupling arms 37L and 37R contact the lower surface of the cartridge tray 35 as is illustrated in FIG. 20A, when the coupling arms 37L and 37R rotate in association with the closing rotation of the door 31. Therefore, it is not possible to close the door 31 and depress the tray holding members 34L and 34R downwardly in the rearward direction of the main body.

Figure 20B:
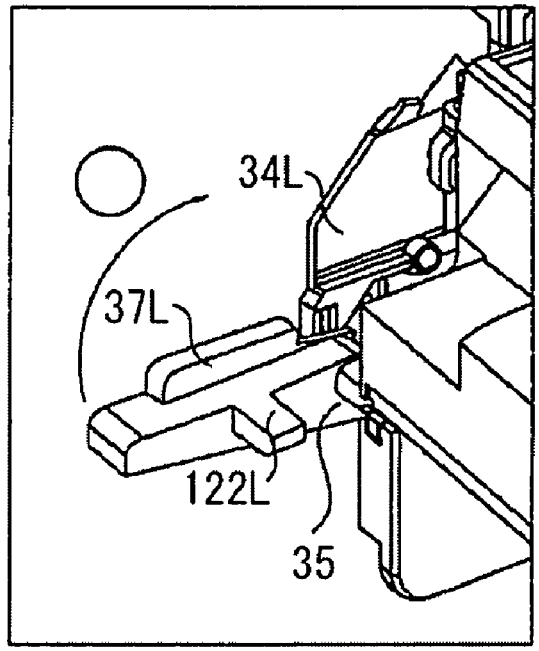

To the contrary, in the state of FIG. 17 that the cartridge tray 35 is sufficiently pushed into a right position, when the coupling arms 37L and 37R rotate in association with the closing rotation of the door 31, the projecting portions 122L and 122R of the coupling arms 37L and 37R, as illustrated in FIG. 20B, do not interfere with the cartridge tray 35. Therefore, the tray holding members 34L and 34R can be depressed toward the lower rear side of the main body of the apparatus after closing the door 31.

As illustrated in FIG. 19, since the cartridge tray 35 is biased from the rear by springs 103 through the pressing members 104, 105, the cartridge tray 35 projects in more than a predetermined amount according to an amount of stroke of the springs 103 as is illustrated in FIG. 19B if the user fails to sufficiently push the cartridge tray 35 to a right position. At this time, the position of the cartridge tray 35 is as illustrated in FIGS. 18 and 20A.

Therefore, if the user erroneously closes the door 31 before completely accommodating the cartridge tray 35 in the loading position, the projecting portions 122L and 122R of the coupling arms 37L, 37R always interfere with the cartridge tray 35, which prompts the user to correct his erroneous operation. To the contrary, in the state that the cartridge tray 35 is sufficiently pushed into the right position as is illustrated in FIGS. 17 and 20B, the cartridge tray 35 can be positioned relative to the main body of the apparatus as is illustrated in FIG. 19A since the stopper claw 101 is engaged with a main body side fitting unit 102.

Therefore, when the user places the cartridge tray 35 in the apparatus to the extent that the stopper claw 101 is engaged with the main body side fitting unit 102, the U-shaped groove 110 of the cartridge tray 35 is engaged with the pin 111 and the projecting portion 67 can be securely positioned in the positioning hole 69 in closing the door 31.

The number or shapes of the stopper claw 101 and the main body side fitting unit 102 of the cartridge tray 35 are not limited to those as illustrated in FIG. 19. In addition, the number or shapes of the pressing units 103 through 105 of the cartridge tray 35 is not limited to those as illustrated in FIGS. 19A and 19B.

In the present exemplary embodiment, the cartridge can be exchanged with ease through a front access. The present exemplary embodiment is configured to exchange the cartridge by withdrawing and placing the cartridge on the tray, position the cartridge using a component of the main body when it is attached. Further, according to the present exemplary embodiment, the drawer roughly holds the cartridge and moves the cartridge only between the withdrawing position and the loading position of the main body. Accordingly, the user sets the cartridge in the drawer with the cartridge facing directly below in a gravity direction at the tray withdrawing position without being concerned about positioning of the cartridge. Then, the tray is pushed into the loading position and the door at the main body front surface is closed, and the user can hold the tray securely at the positioning position. Accordingly, an image forming apparatus that the user can operate with ease and that can position the cartridge with accuracy is provided.

Further, if the user operates the tray before the tray is completely raised, i.e., in a state that the door is halfway opened, the drum of the cartridge may be rubbed by the belt which causes a problem to an image. However, it is possible to cause the tray to stop movement unless the door is completely opened, by moving the door in association with the tray and providing the member for controlling the movement of the door at the front side and the member for controlling the movement of the tray by opening/closing the door.

Further, the tray can be configured to project out in a predetermined amount if the tray is not completely contained. As a consequence, the user can recognize that the door would not be closed if the tray is not completely contained and thus a breakage caused by the erroneous operation by the user is prevented.

Here, the above-described projections 67 and the holes 69 (see FIGS. 11A through 11C, and 13) may be used as alternatives when the position control unit of the cartridge tray 35 as illustrated in FIGS. 19A and 19B is not used. This will be described below in detail with reference to FIGS. 17, 18, and 21A through 21C.

In the state of FIG. 18 that the cartridge tray 35 is not sufficiently pushed into the right position, the projecting portions 67 provided on the cartridge tray 35 do not match the holes 69 that are provided in the intermediate transfer belt tray holding members, serving 68 as the stable units. If the user attempts to close the door 31 in this state, the tray holding members 34R, 34L are depressed through the coupling arms 37L, 37R, and the projecting portions 67 hit the intermediate transfer belt tray holding members 68 when also the cartridge tray 35 is depressed. Therefore, the door 31 cannot be closed.

Figure 21A:
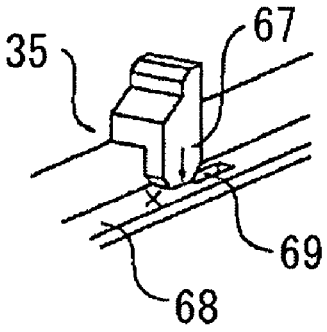
FIGS. 21A through 21C are views illustrating the tray position control unit.
Figure 21B:
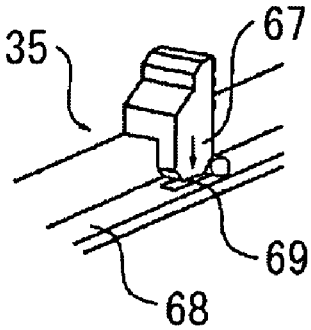
Figure 21C:
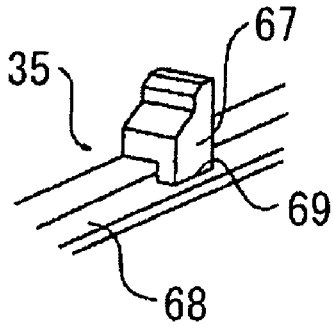

To the contrary, in a state of FIG. 17 that the cartridge tray 35 is sufficiently pushed into the right position, the door 31 can be closed to depress the tray holding members 34R and 34L and the cartridge tray 35, as illustrated in FIGS. 21B and 21C, since the projecting portions 67 enter in the corresponding holes 69 when the cartridge tray 35 is depressed.

Accordingly, the cartridge tray 35 is depressed only when the cartridge tray 35 is positioned at the loading position within the main body of the apparatus in the horizontal direction of the apparatus, and thus each cartridge is securely positioned at the positioning portion 41.

In FIGS. 17 and 18, the projecting portions 67 of the cartridge tray 35 and the holes 69 of the intermediate transfer belt tray holding members 68 having similar shapes are provided at two portions. However, the number or shapes of the projecting portions 67 and the holes 68 are not limited to the ones as illustrated in FIGS. 17, 18, and 21. Moreover, if a plurality of the projecting portions or the holes are provided, those shapes are not necessarily similar to each other. Further, the fitting between the projecting portions 67 and the corresponding holes 69 is not limited to the ones as illustrated in FIGS. 17, 18, and 21A through 21C. Further, the holes 69 may not be necessarily provided in the intermediate transfer belt tray holding members.

With respect to the pin 111 provided on the right frame 80R and the U-shaped groove 110 provided on the cartridge tray 35 as illustrated in FIGS. 11A through 11C, the same effect can be produced. In this case, the number or the shapes of the fitting are not limited to the ones as illustrated in FIGS. 11A through 11C.

FIGS. 22 through 24B illustrate a method of supplying power to each of the cartridges from the main body of the apparatus.

Figure 23:
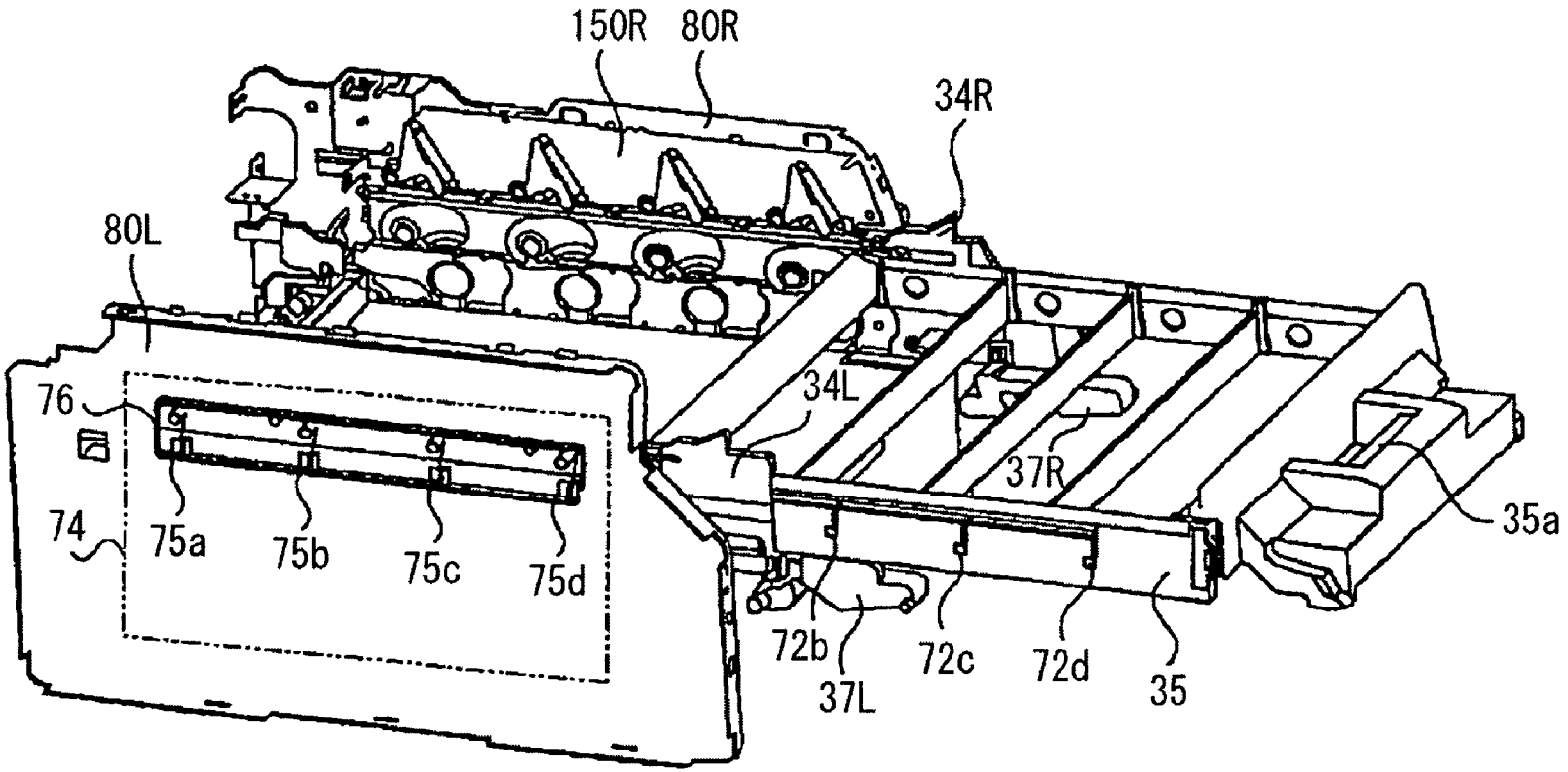
FIG. 23 is a view illustrating a method of feeding the cartridge.

FIGS. 22 and 23 illustrate a state that the door 31 is opened and the cartridge tray 35 is withdrawn. The cartridge tray 35 is provided with a plurality of intermediate electrical contact springs 72*a* through 72*d* such that they are aligned along the horizontal direction of the main body of the apparatus and at the same positions in the vertical direction of the main body and one end of the intermediate electrical contact springs 72*a* through 72*d* is electrically connected to the corresponding electrical contacts 55 of the cartridges (see FIG. 8). More specifically, the cartridge tray 35 as the moving member is provided with the intermediate electrical contacts 72*a* through 72*d*. The intermediate electrical contacts 72*a* through 72*d* is in contact with the electrical contacts 55 of the cartridges.

The main frame of the main body of the apparatus is provided with a plurality of main body electrical contact springs 75*a* through 75*d* which are electrically connected to a main body side power supply portion 74 arranged outside the left frame 80L, along the horizontal direction of the apparatus and at the same positions in the vertical direction of the apparatus. The main body electrical contact springs 75*a* through 75*d* project to the side of the cartridge tray 35 through holes provided in the left frame 80L and the left tray holding member 34L.

Figure 24A:
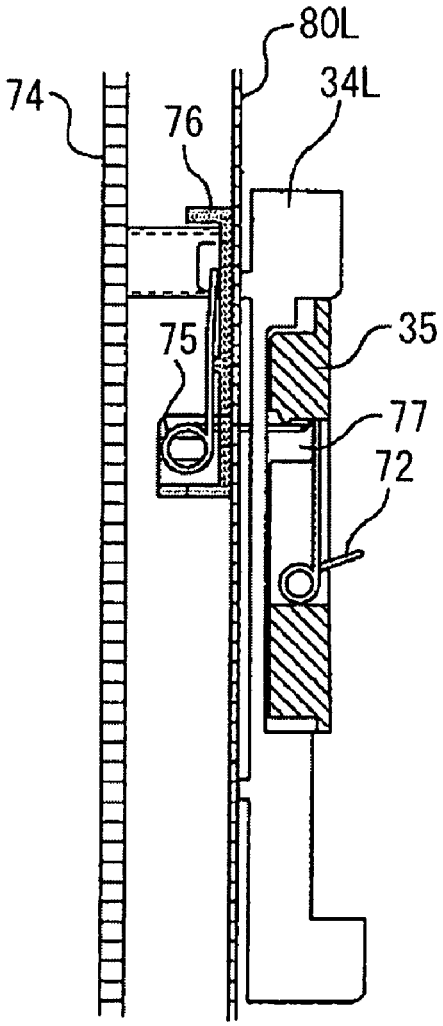
FIGS. 24A and 24B are views illustrating a method of feeding the cartridge.
Figure 24B:
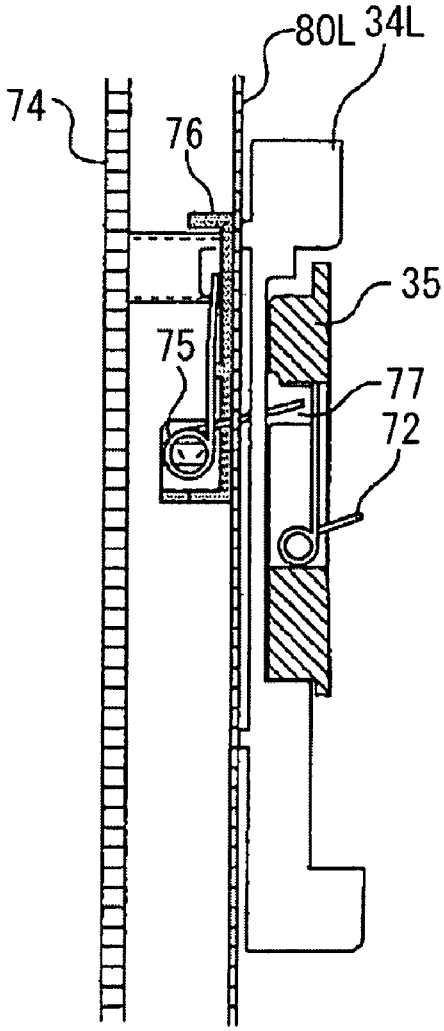

FIGS. 24A and 24B illustrate an electrical connection and an electrical disconnection between the intermediate electrical contact spring 72 provided on the cartridge tray 35 and the main body electrical contact spring 75. More specifically, FIGS. 24A and 24B are views each illustrating a partial perspective view of the cartridge tray 35, the intermediate electrical contact 72, the left tray holding member 34L, the left frame 80L, the main body electrical contact spring 75, a main body electrical contact spring holder 76, and the main body side power supply portion 74, viewed from the front of the main body of the apparatus.

With reference to FIG. 24A, the left holding member 34L and the cartridge tray 35 are descended to an image forming position when the door 31 closed. At this time, the main body electrical contact spring 75 and the intermediate electrical contact spring 72 are electrically connected to each other.

With reference to FIG. 24B, the left tray holding member 34L and the cartridge tray 35 are in a ascended position from the image forming position when the door 31 is opened. At this time, the main body electrical contact spring 75 and the intermediate electrical contact spring 72 are brought into an electrically disconnected state. Further, the cartridge tray 35 has a groove 77 along the longitudinal direction of the main body of the apparatus so as not to contact with a portion of the main body electrical contact spring 75 projecting to a side of the cartridge 35 from the left tray holding member 34L. Accordingly, the cartridge tray 35 can be withdrawn without contacting the main body electrical contact spring 75.

The main body of the apparatus includes the main body electrical contacts 75*a* through 75*d* disposed apart from a moving path of the intermediate electrical contacts 72*a* through 72*d* of the cartridge tray 35.

The intermediate electrical contacts and the main body electrical contacts are disconnected from each other by moving the cartridge tray 35 upwardly from the image forming position (ascending) and are electrically connected to each other by moving the cartridge tray 35 downwardly toward the image forming position (descending) using the tray holding members 34L and 34R.

In FIGS. 22 through 24B, one main body electrical contact spring and one intermediate electrical contact spring are used to supply power to one power supply receiving portion of each cartridge. However, such a configuration may also be available when each cartridge includes a plurality of power supply receiving portions. Further, in a case where the plurality of power supply receiving portions are provided at different heights in a vertical direction of the main body of the apparatus, a similar configuration is also available if the main body electrical contact springs are disposed at different heights, and a plurality of grooves is arranged at positions corresponding to the heights of the main body electrical contacts of the tray.

Further, in a case where the same bias is applied to the plurality of cartridges, a conductor as one intermediate electrical contact that is electrically connectable/disconnectable with one main body electrical contact spring is provided in the tray. Then, a plurality of intermediate contact springs are provided in the tray such that one end of the intermediate contact springs are electrically connected to the conductor, and the other end thereof is electrically connectable/disconnectable with the plurality of power supply receiving portions of the cartridge. With such a configuration, the number of connecting points between the intermediate contact springs and the main body electrical contact springs can be reduced. Further, the shapes of main body electrical contact springs and the intermediate contact springs, or a direction of a contact pressure at each of the electrically contact portions are not limited to the ones as illustrated in FIGS. 22 through 24B.

The present exemplary embodiment includes the conductor configured to divide an electrical connection in the cartridge tray 35 and more electrically contacting portions between the intermediate electrical contacts and the electrical contacts of the cartridge are provided than the electrically contact portions between the intermediate electrical contacts and the main body electrical contacts. Accordingly, the number of parts can be reduced and thus the cost can be decreased in the case where the same potential is applied for every color.

As described above, the cartridges are placed on the moving member (tray), the process cartridges are exchanged through the front access, and the moving members are provided with the intermediate electrical contacts. Further, the electrical contacts are connected/disconnected according to the up-and-down movement of the moving member. As a result, the image forming apparatus in which a process cartridge can be exchanged by an easy withdrawing method can be provided without an increase of cost and size.

Further, the cartridge can be exchanged with an operation that is readily conceivable to a user since the moving member moves in an up-and-down direction in association with the member which opens/closes the opening. Still further, a space in a vertical direction can be saved and the main body can be reduced in size since the plurality of electrical contacts are horizontally disposed at the same positions in the vertical direction.

FIGS. 25A, 25B, 26, and 27 are perspective views illustrating a frame configuration constituting a framework of the main body of the image forming apparatus. The left frame 80L (see FIG. 17) and the right frame 80R, i.e., the first and the second main frames of the main body of the apparatus are fastened by stay members 130F, 130R, 131, 132, i.e., connecting members, to each other. In other words, the connecting members 130F, 130R, 131 and 132 connect two sideplates 80L and 80R.

Positioning members 81L and 81R holding the process cartridges and the belt unit, are disposed on the stay members 131 and 132. In other words, the positioning members 81L, 81R are held by the connecting members 131 and 132.

The positioning members 81L and 81R position the process cartridges PY, PM, PC and PK and the belt unit 12. Each of the positioning members 81L and 81R is provided with four positioning portions, 41M, 41C and 41K which are engaged with the corresponding bearing portions 51, 52 of the process cartridges PY, PM, PC and PK to determine a position of the process cartridges. In other words, when the moving member 35 is moved to contain the process cartridges within the main body of the apparatus, i.e., when the process cartridges reach the image forming position, the positions of the process cartridges are determined by the positioning members 81L and 81R.

The positioning portions 41Y, 41M, 41C and 41K are formed in a shallow V-shape facing upward, and, as described above, the process cartridges PY, PM, PC and PK are positioned when they are depressed by the pressing members 42. In other words, the positioning members 81L and 81R are provided in the direction the moving member 35 moves, and the process cartridges are pressed in a direction perpendicular to the moving direction of the moving members 35 in order to be positioned. Since the positioning portions are shallow, the process cartridges PY, PM, PC and PK can be withdrawn in a horizontal direction without interfering with the positioning members 81L and 81R, only by slightly picking up the process cartridges.

On the other hand, the belt unit 12 is disposed between the two positioning members 81L, 81R and is positioned by fitting positioning bosses 143, 144 into the positioning portions 83D, 83T of the positioning members 81L, 81R.

The positioning members 81L and 81R are designed in the same shape and thus can be processed using the same dies. Therefore, relative size difference between the positioning members 81L and 81R is small, which is advantageous in the precise positioning of the process cartridges PY, PM, PC and PK and the belt unit 12. The positioning members 81L and 81R are bent into an L-shape and fastened on the stay members 131 and 132 by screws. More specifically, the positioning members 81L and 81R are made of two members, and the two positioning members 81L and 81R have the same shape.

The stay members 130F and 130R adjust a position of a scanner unit 11. The legs 11*a*, 11*b* and 11*c* of the scanner unit 11 are grounded on the stay members 130F and 130R to determine the position of the scanner unit 11 in a height direction. The leg 11*a* fits into cutting portion 82R of the stay member 130R, and the legs 11*b*, 11*c* fit into cutting portion 82*a*,82*b* of the stay member 130F. Further, the positioning bosses lid and lie of the scanner unit 11 are fit into the positioning holes 82*c* and 82*d* of the stay member 130F so that a horizontal position of the scanner unit 11 is determined. As described above, when the cartridges are exchanged, the process cartridges can be withdrawn by slightly picking up the process cartridges. Therefore, no large space is required below the scanner unit for exchanging the cartridges.

Figure 30:
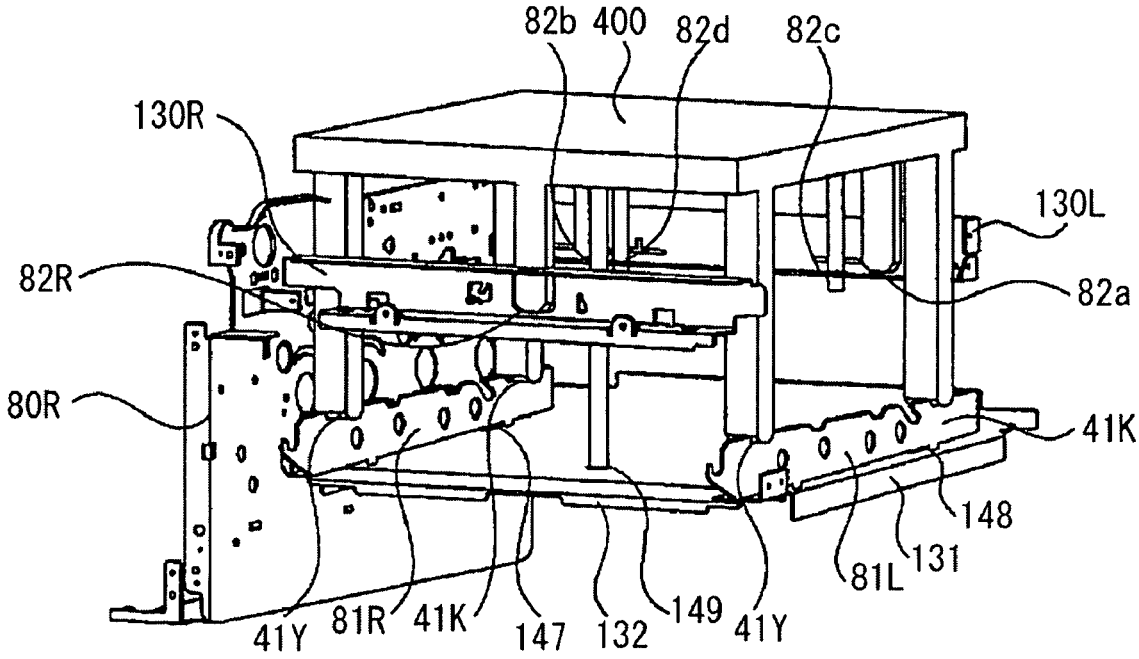
FIG. 30 is a schematic view illustrating a main body assembling tool.

FIG. 30 is a schematic view illustrating an assembly of a main body frame of the image forming apparatus.

The positioning members and the stay members are fastened by the screws while the process cartridge positioning portions 41Y and 41K and the scanner unit positioning portion 82 are in contact with an assembling tool 400. As a consequence, positioning accuracy of the main body frame is guaranteed.

The positioning members 81L and 81R are held by the stay member 131 and the stay member 132. Contacting portions 147, 148 and 149 of the stay member 131 are upwardly processed by half-blanking, and the other portion includes a space between the stay member 131 and the positioning members 81L and 81R. The stay member 131 is fastened by screws while three points of the contacting portions 147, 148 and 149 are pressed against the assembling tool 400 and the positioning members 81L and 81R.

Further, the stay member 132 is fastened by screws while it is pressed against the positioning members 81L and 81R. While a sheet metal part such as a cold rolled steel plate is generally used in the main body frame configuration, its part accuracy such as a curve or a twist of a plane can go down depending on the size thereof.

Further, it is hard to correct the part accuracy of a sheet metal having high rigidity. Although the positioning members 81L, 81R can also be fastened only to the stay member 131, desired positioning accuracy of the positioning members 81L and 81R may not be obtained under the influence of the part accuracy of the stay member 131.

In the present exemplary embodiment, the positioning members 81L and 81R are held by two stay members 131 and 132 and their contacting area is reduced so that the effect of the part accuracy of the stay members 131 and 132 can be eliminated. Accordingly, the main body frame can be assembled with high accuracy.

The stay members 131 and 132 have a simple beam structure in which both ends of the stay members 131 and 132 are fastened to the left frame 80L and the right frame 80R. Accordingly, the stay members 131 and 132 can secure a strength against a dead-load such as the own weight of the process cartridges or a pressing force and an impact load according to a distribution thereof.

Figure 28:
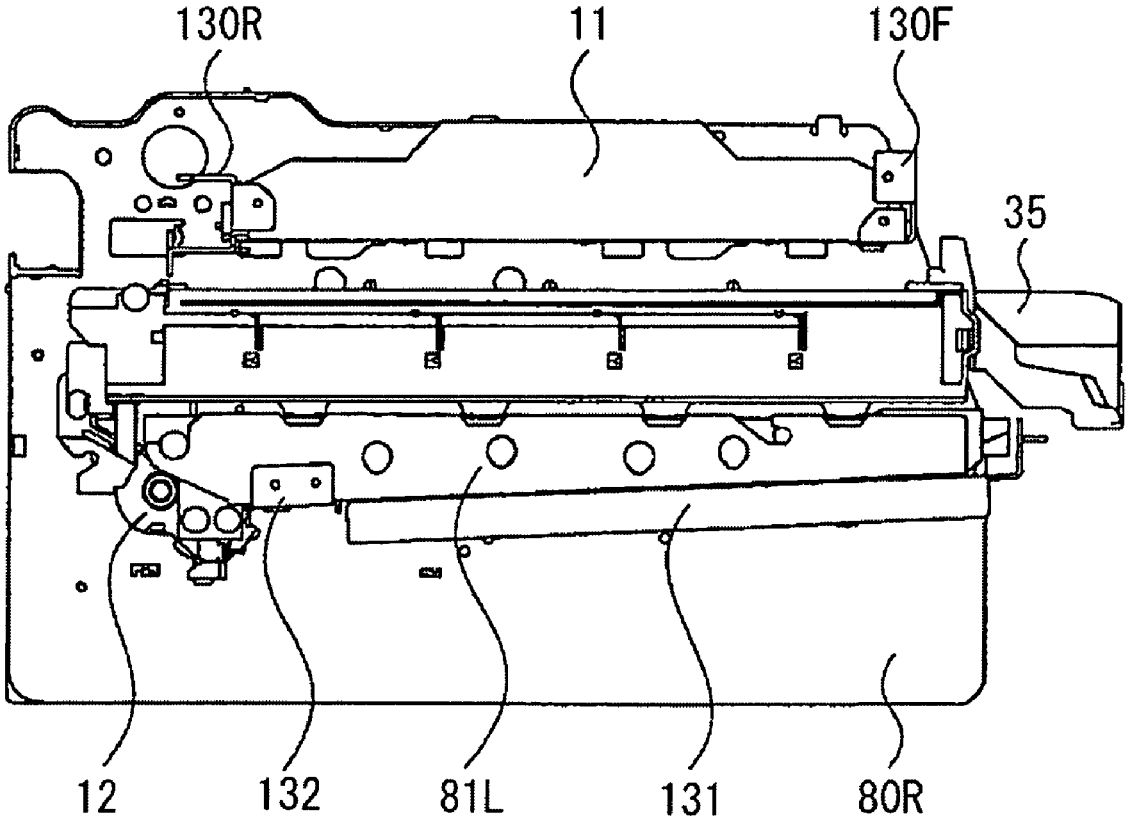
FIG. 28 is a view illustrating configurations of the stay member and the positioning member.
Figure 29:
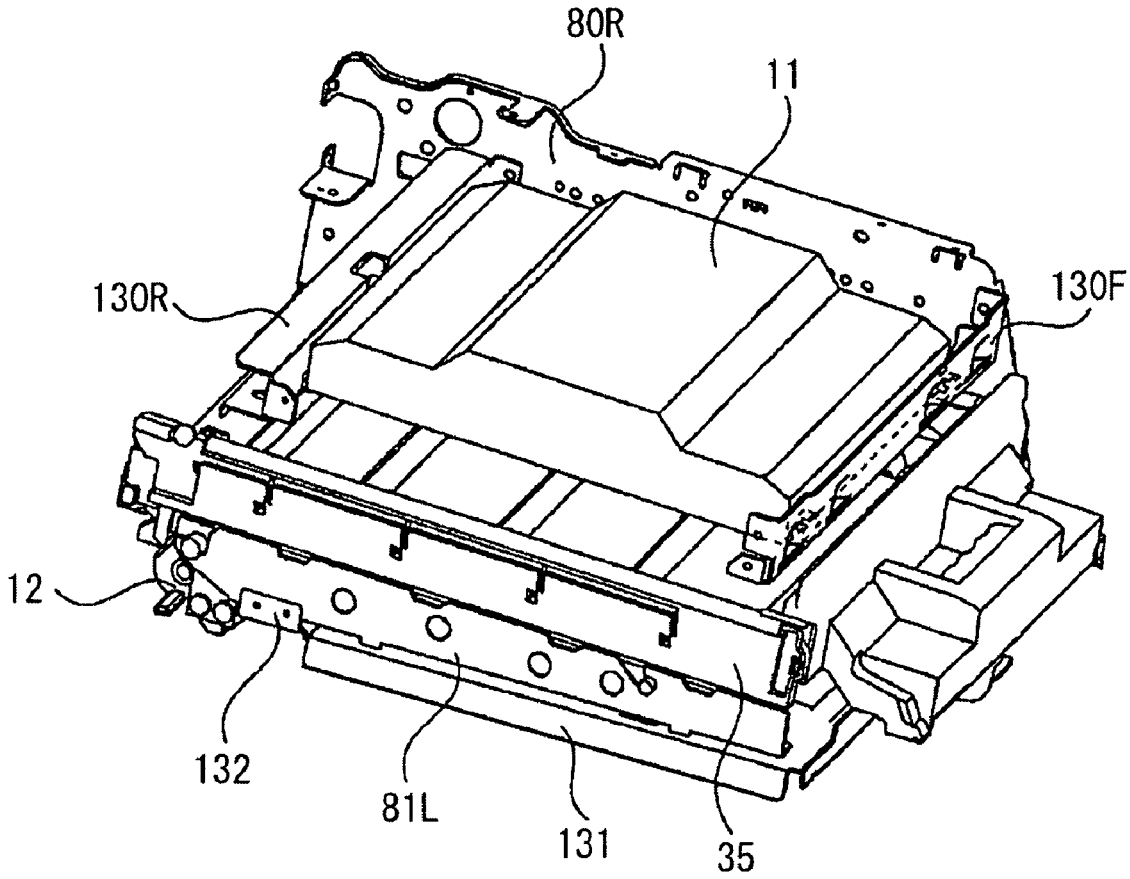
FIG. 29 is a view illustrating configurations of the stay member and the positioning member.

As illustrated in FIGS. 28 and 29, the positioning members 81L and 81R are disposed below the moving range of the cartridge tray 35. If the positioning members 81L and 81R are fastened directly to the side plates, they may hinder movement of the cartridge tray 35 and the tray holding members 34L and 34R provided at the inside of the side plates, and may increase a size of the main body of the apparatus. However, in the present exemplary embodiment, the space between the side plates can be used effectively. The stay member 130F is disposed above the moving range of the cartridge tray 35 and thus a large opening portion can be provided in the front of the main body. Therefore, the cartridge tray 35 can be moved without increasing the size of the main body.

As described above, the image forming apparatus of the present exemplary embodiment can enable easy exchange of the process cartridges by the movement operation of the tray, so that the usability in exchanging the process cartridges can be improved and the process cartridges can be positioned with high accuracy in image formation.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2007-301816 filed Nov. 21, 2007, which is hereby incorporated by reference herein in its entirety.

What is claimed is:

1. An image forming apparatus comprising:

two side-plates configured to be opposed to each other and to form a frame of a main body of the apparatus;

a cartridge with an image bearing member;

a moving member configured to support and move the cartridge, wherein the moving member is movable between the two side-plates, and the cartridge is attachable to and detachable from the moving member when the moving member is withdrawn to the outside of the main body of the apparatus;

a connecting member configured to connect the two side-plates; and a positioning member held by the connecting member;

wherein the cartridge is pressed to the positioning member and is positioned by the positioning member when the moving member is moved and the cartridge is contained in the main body of the apparatus, and wherein the positioning member projects from the connecting member in a direction opposite to a direction in which the cartridge is pressed to the positioning member.

2. The image forming apparatus according to claim 1, wherein the positioning member is provided along a moving direction of the moving member, and the cartridge is pressed from a direction perpendicular to the moving direction of the moving member and is positioned.

3. The image forming apparatus according to claim 1, wherein the positioning member includes two positioning members, the two positioning members having the similar shape.

4. The image forming apparatus according to claim 1, wherein there are two positioning members for supporting each end of the cartridge, and wherein the two positioning members are held by the connecting member in common.

5. The image forming apparatus according to claim 4, wherein the connecting member includes a first connecting member and a second connecting member, and each of the two positioning members is held by the first connecting member and the second connecting member.

6. The image forming apparatus according to claim 1, wherein the cartridge is pressed from a direction perpendicular to the moving direction of the moving member and is positioned.

7. The image forming apparatus according to claim 6 comprising:

a moving unit disposed between the two side-plates and the moving member and configured to movably hold the moving member, wherein the moving unit moves in the direction perpendicular to the moving direction of the moving member so that the cartridge is pressed to the positioning member.

8. The image forming apparatus according to claim 1, wherein the moving member moves while supporting a plurality of cartridges including image bearing members for bearing images of colors different from one another, and the moving direction of the moving member is along a direction in which the plurality of cartridges are arranged.

* * * * *